US008644517B2

(12) United States Patent
Beaucoup

(10) Patent No.: US 8,644,517 B2
(45) Date of Patent: Feb. 4, 2014

(54) SYSTEM AND METHOD FOR AUTOMATIC DISABLING AND ENABLING OF AN ACOUSTIC BEAMFORMER

(75) Inventor: Franck Beaucoup, Vancouver (CA)

(73) Assignee: Broadcom Corporation, Irvine, CA (US)

( * ) Notice: Subject to any disclaimer, the term of this patent is extended or adjusted under 35 U.S.C. 154(b) by 1137 days.

(21) Appl. No.: 12/578,708

(22) Filed: Oct. 14, 2009

(65) Prior Publication Data

US 2011/0038486 A1 Feb. 17, 2011

Related U.S. Application Data

(60) Provisional application No. 61/234,610, filed on Aug. 17, 2009.

(51) Int. Cl.
*H04R 29/00* (2006.01)

(52) U.S. Cl.
USPC ..... 381/56; 381/92

(58) Field of Classification Search
USPC ..... 381/56, 92, 94.3, 94.1, 122, 123, 66, 381/83, 318, 312, 313, 317; 700/94
See application file for complete search history.

(56) References Cited

U.S. PATENT DOCUMENTS

| | | | | |
|---|---|---|---|---|
| 4,536,887 | A * | 8/1985 | Kaneda et al. | 381/92 |
| 4,741,038 | A * | 4/1988 | Elko et al. | 381/92 |
| 8,218,786 | B2 * | 7/2012 | Koga et al. | 381/92 |
| 2003/0051532 | A1 * | 3/2003 | Beaucoup et al. | 73/40.5 A |
| 2005/0094795 | A1 * | 5/2005 | Rambo | 379/202.01 |
| 2006/0133622 | A1 * | 6/2006 | Chen | 381/92 |
| 2008/0201138 | A1 * | 8/2008 | Visser et al. | 704/227 |
| 2010/0241428 | A1 * | 9/2010 | Yiu | 704/233 |
| 2011/0038229 | A1 * | 2/2011 | Beaucoup | 367/119 |

OTHER PUBLICATIONS

McCowan, Microphone Arrays: a Tutorial, Apr. 2001, p. 14.*
Van Veen, et al., "Beamforming: A Versatile Approach to Spatial Filtering", IEEE ASSP Magazine, (Apr. 1988), 21 pages.
McCowan, Iain "Microphone Arrays: A Tutorial (report extracted from PhD Thesis "Robust Speech Recognition using Microphone Arrays," Queensland University of Technology, Australia, 2001)", downloaded from <http://www.idiap.ch/~mccowan/arrays/arrays.html> on Feb. 25, 2009, 36 pages.
U.S. Appl. No. 12/566,329, filed Sep. 24, 2009, 39 pages.

* cited by examiner

*Primary Examiner* — Vivian Chin
*Assistant Examiner* — Friedrich W Fahnert
(74) *Attorney, Agent, or Firm* — Fiala & Weaver P.L.L.C.

(57) ABSTRACT

A system and method that automatically disables and/or enables an acoustic beamformer is described herein. The system and method automatically generates an output audio signal by applying beamforming to a plurality of audio signals produced by an array of microphones when it is determined that such beamforming is working effectively and generates the output audio signal based on an audio signal produced by a designated microphone within the array of microphones when it is determined that the beamforming is not working effectively. Depending upon the implementation, the determination of whether the beamforming is working effectively may be based upon a measure of distortion associated with the beamformer response, an estimated level of reverberation, and/or the rate at which a computed look direction used to control the beamformer changes.

35 Claims, 10 Drawing Sheets

SYSTEM AND METHOD FOR AUTOMATIC DISABLING AND ENABLING OF AN ACOUSTIC BEAMFORMER

CROSS-REFERENCE TO RELATED APPLICATIONS

This application claims priority to U.S. Provisional Patent Application No. 61/234,610 filed Aug. 17, 2009, the entirety of which is incorporated by reference herein.

BACKGROUND OF THE INVENTION

1. Field of the Invention

The present invention generally relates to systems that perform acoustic beamforming based on audio input received via an array of microphones.

2. Background

As used herein, the term acoustic beamforming, or simply beamforming, refers to a method for spatially filtering sound waves received by an array of microphones via processing of the audio signals produced by the array. Beamforming may be used to generate an audio signal in which components attributable to sound waves arriving at the array from a particular direction or directions are attenuated relative to components attributable to sound waves arriving from another direction or direction(s). If the position of a desired audio source (e.g., a talker) relative to the microphone array is known and/or the position of an undesired audio source (e.g., a source of noise or interference) relative to the microphone array is known, then beamforming can advantageously be used to attenuate the undesired audio source relative to the desired audio source. Logic that performs beamforming may be referred to as a beamformer.

Beamformers operate by selectively weighting audio signals produced by the microphone array such that the level of the response of the array is dependent upon the sound wave direction of arrival. The relationship between the sound wave direction of arrival and the response level of the microphone array is often graphically represented as a "beam pattern." A beam pattern may have one or more lobes, or areas of relatively strong response, as well as one or more nulls, or areas of relatively weak response. The lobe providing the maximum level of response is often referred to as the main lobe. A main lobe of a beam pattern may be referred to simply as a "beam." The direction in which a beam is pointed may be referred to as the "look direction" of the beam.

A beamformer may utilize a fixed or adaptive beamforming algorithm to produce a particular beam pattern. In fixed beamforming, the weights applied to the audio signals generated by the microphone array are pre-computed and held fixed during deployment. The weights are independent of observed target and/or interference signals and depend only on an assumed source and/or interference location. In contrast, in adaptive beamforming, the weights applied to the audio signals generated by the microphone array may be modified during deployment based on observed signals to take into account a changing source and/or interference location. Adaptive beamforming may be used, for example, to steer spatial nulls in the direction of discrete interference sources. An audio source localization technique may be used to estimate the current source and/or interference location.

Beamforming may be used in a variety of applications. For example, beamforming may be used in speakerphones, audio teleconferencing and audio/video teleconferencing systems to direct a beam in the direction of a near-end talker, thereby improving the quality of a near-end speech signal obtained for transmission to a far-end listener. However, there are various issues associated with speakerphones and teleconferencing systems that use beamforming that can lead to distortion of the near-end speech signal. One issue arises when the near-end talker is outside of the "normal" spatial range to which beams are directed. To address this issue, the normal spatial range covered by the beams may be expanded. However, this comes at the cost of high computational complexity. Another possible way to address this issue is to allow a user to manually disable the beamforming functionality and revert to the use of a primary microphone. This approach is disadvantageous in that it requires manual intervention by the user and also requires a far-end listener to provide feedback regarding the quality of the transmitted speech signal.

Another issue that can lead to distortion of the near-end speech signal is that a talker localization algorithm used to identify an optimal look direction for acoustic beamforming may select the wrong look direction. For example, the talker localization algorithm may select the wrong look direction because it is operating in a highly reverberant environment with strong reflections. A further issue that can lead to the distortion of the near-end speech signal is the placement of a speakerphone/teleconferencing system in an environment that deviates from the assumed acoustic model used to design the beamformer.

Still another issue that can lead to the distortion of the near-end speech signal is that there may be a gain and/or phase mismatch between two or more microphones in the microphone array used to perform beamforming. Factory calibration may be performed to address this issue. However, this may be expensive and doesn't address environmental damage or gradual drift. On-the-fly auto-calibration features may be built into the speakerphone/teleconferencing system. However, such features are difficult to use without precise knowledge of the spatial properties of the calibration signal and/or the acoustic environment.

When beamforming is working effectively, it can significantly increase the quality of the near-end speech signal by attenuating undesired audio sources as described above. However, as also described above, when beamforming is not working effectively, the near-end speech signal may be distorted, thereby impairing the ability of the far-end listener to perceive and/or understand the signal. What is needed, then, is a system and method for handling variations in the level of performance of a beamformer in a manner that addresses one or more of the aforementioned shortcomings associated with prior art solutions.

BRIEF SUMMARY OF THE INVENTION

A system and method that automatically disables and/or enables an acoustic beamformer is described herein. The system and method automatically generates an output audio signal by applying beamforming to a plurality of audio signals produced by an array of microphones when it is determined that such beamforming is working effectively and generates the output audio signal based on an audio signal produced by a designated microphone within the array of microphones when it is determined that the beamforming is not working effectively. Depending upon the implementation, the determination of whether the beamforming is working effectively may be based upon a measure of distortion associated with the beamformer response, an estimated degree of reverberation, and/or the frequency at which a look direction used to control the beamformer changes.

In particular, a method for generating an output audio signal is described herein. In accordance with the method, a plurality of audio signals produced by an array of microphones is received. The plurality of audio signals is processed in a beamformer to produce a beam response. A measure of distortion is calculated for the beam response. It is then determined if the measure of distortion exceeds a first threshold. Responsive to at least determining that the measure of distortion exceeds the first threshold, a switch is made from a first mode of operation in which the output audio signal is generated by applying beamforming to the plurality of audio signals produced by the array of microphones to a second mode of operation in which the output audio signal is generated from an audio signal produced by a designated microphone in the array of microphones.

In accordance with one implementation of the foregoing method, processing the plurality of audio signals in a beamformer comprises processing the plurality of audio signals in a superdirective beamformer, such as a Minimum Variance Distortionless Response (MVDR) beamformer.

In accordance with a further implementation of the foregoing method, calculating the measure of distortion includes calculating an absolute difference between a power of the beam response and a reference power. The reference power may comprise, for example, a power of a response of a single microphone in the array of microphones or an average response power of two or more microphones in the array of microphones. In accordance with an alternate implementation, calculating the measure of distortion includes calculating a power of a difference between the beam response and a reference response. The reference response may comprise, for example, a response of a single microphone in the array of microphones.

In accordance with a still further implementation of the foregoing method, calculating the measure of distortion includes (a) calculating a measure of distortion for the beam response at each of a plurality of frequencies and (b) summing the measures of distortion calculated in step (a). Alternatively, calculating the measure of distortion may include (a) calculating a measure of distortion for the beam response at each of a plurality of frequencies, (b) multiplying each measure of distortion calculated in step (a) by a frequency-dependent weight to produce a plurality of frequency-weighted measures of distortion, and (c) summing the frequency-weighted measures of distortion calculated in step (b).

In accordance with another implementation of the foregoing method, the receiving, processing and calculating steps are performed on a periodic basis and switching from the first mode of operation to the second mode of operation responsive to at least determining that the measure of distortion exceeds the first threshold includes switching from the first mode of operation to the second mode of operation responsive to at least determining that the measure of distortion exceeds the first threshold for a predetermined number of periods.

In accordance with yet another implementation of the foregoing method, the method further includes switching from the second mode of operation to the first mode of operation responsive to at least determining that the measure of distortion does not exceed a second threshold for a predetermined number of periods.

An alternate method for generating an output audio signal is also described herein. In accordance with the method, a degree of reverberation is calculated based on one or more of a plurality of audio signals produced by an array of microphones. It is determined if the degree of reverberation exceeds a first threshold. Responsive to at least determining that the degree of reverberation exceeds the first threshold, a switch is made from a first mode of operation in which the output audio signal is generated by applying beamforming to the plurality of audio signals produced by the array of microphones to a second mode of operation in which the output audio signal is generated from the audio signal produced by a designated microphone in the array of microphones. The foregoing method may further include switching from the second mode of operation to the first mode of operation responsive to at least determining that the level of reverberation does not exceed a second threshold.

A further alternate method for generating an output audio signal is described herein. In accordance with the method, the following steps are performed on a periodic basis: a plurality of audio signals is received from an array of microphones, the plurality of audio signals produced by the array of microphones is processed in a first beamformer to produce a plurality of beam responses, a look direction associated with one of the plurality of beam responses is selected, and the selected look direction is used to steer a second beamformer that processes the plurality of audio signals. Responsive to at least determining that a rate at which the selected look direction changes exceeds a first threshold, a switch is made from a first mode of operation in which the output audio signal is generated by the second beamformer to a second mode of operation in which the output audio signal is generated from an audio signal produced by a designated microphone in the array of microphones. The foregoing method may further include switching from the second mode of operation to the first mode of operation responsive to at least determining that the rate at which the selected look direction changes does not exceed a second threshold.

A system is also described herein. The system includes an array of microphones, a beamformer, a distortion calculator and an output audio signal generator. The beamformer processes a plurality of audio signals produced by the array of microphones to produce a beam response. The distortion calculator calculates a measure of distortion for the beam response. The output audio signal generator determines if the measure of distortion exceeds a first threshold and switches from a first mode of operation in which an output audio signal is generated by applying beamforming to the plurality of audio signals produced by the array of microphones to a second mode of operation in which the output audio signal is generated from an audio signal produced by a designated microphone in the array of microphones responsive to at least determining that the measure of distortion exceeds the first threshold.

An alternate system is described herein. The system includes an array of microphones, a reverberation calculator and an output audio signal generator. The reverberation calculator calculates a degree of reverberation based on one or more of a plurality of audio signals produced by the array of microphones. The output audio signal generator determines if the degree of reverberation exceeds a first threshold and switches from a first mode of operation in which an output audio signal is generated by applying beamforming to the plurality of audio signals produced by the array of microphones to a second mode of operation in which the output audio signal is generated from the audio signal produced by a designated microphone in the array of microphones responsive to at least determining that the degree of reverberation exceeds the first threshold.

A further alternate system is described herein. The system includes an array of microphones, audio source localization logic and an output audio signal generator. The audio source localization logic periodically processes a plurality of audio signals produced by the array of microphones in a first beamformer to produce a plurality of beam responses, selects a look direction associated with one of the plurality of beam responses, and uses the selected look direction to steer a second beamformer that processes the plurality of audio signals. The output audio signal generator switches from a first mode of operation in which an output audio signal is generated by the second beamformer to a second mode of operation in which the output audio signal is generated from an audio signal produced by a designated microphone in the array of microphones responsive to at least determining that a rate at which the selected look direction changes exceeds a first threshold.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention.

Figure 1:
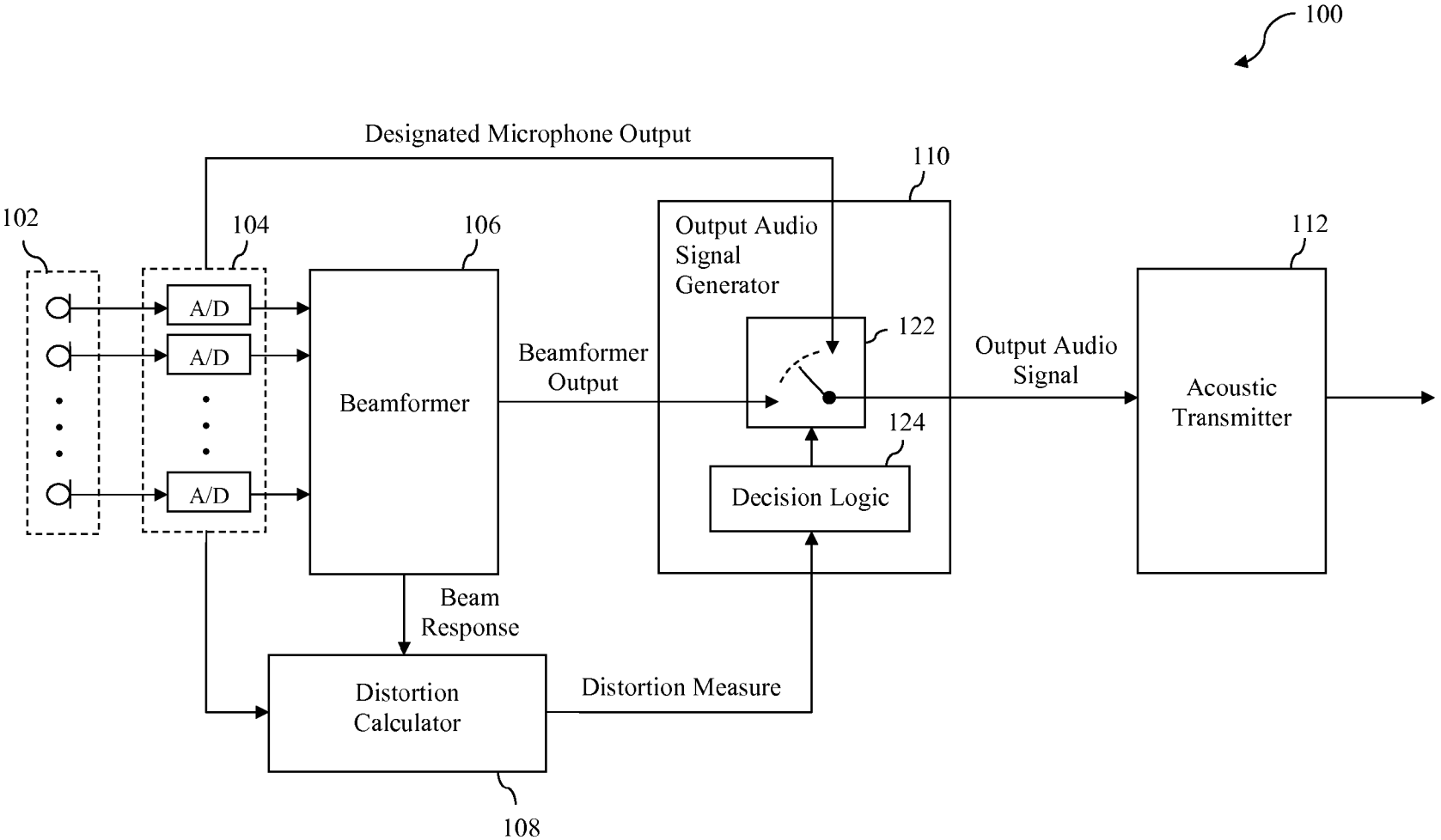
FIG. 1 is a block diagram of a system that automatically disables and enables an acoustic beamformer in accordance with an embodiment of the present invention.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF THE INVENTION

A. Introduction

The following detailed description of the present invention refers to the accompanying drawings that illustrate exemplary embodiments consistent with this invention. Other embodiments are possible, and modifications may be made to the embodiments within the spirit and scope of the present invention. Therefore, the following detailed description is not meant to limit the invention. Rather, the scope of the invention is defined by the appended claims.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to implement such feature, structure, or characteristic in connection with other embodiments whether or not explicitly described.

B. Example System that Automatically Disables and Enables an Acoustic Beamformer FIG. 1 is a block diagram of an example system 100 that automatically disables and enables an acoustic beamformer in accordance with an embodiment of the present invention. System 100 is intended to represent a system that captures audio input for acoustic transmission and thus may represent, for example, a speakerphone, a mobile phone with speakerphone capability, an audio teleconferencing system, an audio/video teleconferencing system, or the like. However, these examples are not intended to be limiting and persons skilled in the relevant art(s) will readily appreciate that the features described herein relating to automatic disabling/enabling of a beamformer may be implemented in any system or device that captures audio input for any application or purpose whatsoever. Thus, an embodiment of the present invention may be implemented in devices/systems other than those specifically described herein and may be used to support applications other than those specifically described herein.

As shown in FIG. 1, system 100 includes a number of interconnected components including an array of microphones 102, an array of analog-to-digital (A/D) converters 104, a beamformer 106, a distortion calculator 108, an output audio signal generator 110, and an acoustic transmitter 112. Each of these components will now be described.

Microphone array 102 comprises two or more microphones that are mounted or otherwise arranged in a manner such that at least a portion of each microphone is exposed to sound waves emanating from audio sources proximally located to system 100. Each microphone in array 102 comprises an acoustic-to-electric transducer that operates in a well-known manner to convert such sound waves into an analog audio signal. The analog audio signal produced by each microphone in microphone array 102 is provided to a corresponding A/D converter in array 104. Each A/D converter in array 104 operates to convert an analog audio signal produced by a corresponding microphone in microphone array 102 into a digital audio signal comprising a series of digital audio samples prior to delivery to beamformer 106.

Beamformer 106 is connected to array of A/D converters 104 and receives digital audio signals therefrom. Beamformer 106 is configured to process the digital audio signals to produce a response that corresponds to a beam having a particular look direction. As noted above, the term "beam" refers to the main lobe of a spatial sensitivity pattern (or "beam pattern") implemented by a beamformer through selective weighting of the audio signals produced by a microphone array. By controlling the weights applied to the signals produced by the microphone array, a beamformer may point or steer the beam in a particular direction, which is sometimes referred to as the "look direction" of the beam. Depending upon the implementation, the look direction of the beam may be fixed or may change over time.

In one embodiment, beamformer 106 determines the beam response by determining a beam response at each of a plurality of frequencies at a particular time. For example, beamformer 106 may determine for each of a plurality of frequencies:

$$B(f,t),$$

wherein B(f,t) is the response of a particular beam at frequency f and time t.

The beam response obtained by beamformer 106 is provided to distortion calculator 108. Beamformer 106 also uses the beam response to produce a spatially-filtered audio signal (denoted "beamformer output" in FIG. 1) which is provided to output audio signal generator 110.

In one embodiment of the present invention, beamformer 106 comprises a superdirective beamformer. That is to say, beamformer 106 uses a superdirective beamforming algorithm to acquire beam response information. For example, beamformer 106 may comprise a Minimum Variance Distortionless Response (MVDR) beamformer that acquires beam response information using an MVDR algorithm. As will be appreciated by persons skilled in the relevant art(s), in MVDR beamforming, the beamformer response is constrained so that signals from the direction of interest are passed with no distortion relative to a reference response. The response power in certain directions outside of the direction of interest is minimized.

Beamformer 106 may utilize a fixed or adaptive beamforming algorithm, such as a fixed or adaptive MVDR beamforming algorithm, in order to produce a beam and a corresponding beam response. As will be appreciated by persons skilled in the relevant art(s), in fixed beamforming, the weights applied to the audio signals generated by the microphone array are pre-computed and held fixed during deployment. The weights are independent of observed target and/or interference signals and depend only on the assumed source and/or interference location. In contrast, in adaptive beamforming, the weights applied to the audio signals generated by the microphone array may be modified during deployment based on observed signals to take into account a changing source and/or interference location. Adaptive beamforming may be used, for example, to steer spatial nulls in the direction of discrete interference sources.

Although the foregoing describes the use of a superdirective beamformer, such as an MVDR beamformer, to implement beamformer 106 it is to be understood that the present invention is not limited to such an implementation and other types of beamformers may be used.

Distortion calculator 108 is configured to receive one or more of the digital audio signals generated by array of A/D converters 104 and to process the signal(s) to produce a reference power or reference response therefrom. Distortion calculator 108 is further configured to calculate a measure of distortion for the beam response received from beamformer 106 with respect to the reference power or reference response. Distortion calculator 108 is further configured to provide the measure of distortion for the beam response to output audio signal generator 110.

In one embodiment, distortion calculator 108 is configured to calculate the measure of distortion for the beam response received from beamformer 106 by calculating an absolute difference between a power of the beam response and a reference power. The measure of distortion in such an embodiment may be termed the response power distortion. For example, distortion calculator 108 may calculate the measure of distortion for the beam response by calculating:

$$||B(t)|^2-|mic(t)|^2|,$$

wherein B (t) is the response of the beam at time t, $|B(t)|^2$ is the power of the response of the beam at time t, $|mic(t)|^2$ is the reference power at time t, and $||B(t)|^2-|mic(t)|^2|$ is the response power distortion for the beam at time t.

In the foregoing embodiment, the reference power comprises the power of a response of a designated microphone in the array of microphones, wherein the response of the designated microphone at time t is denoted mic(t). In an alternate embodiment, the reference power may comprise an average response power of two or more designated microphones in the array of microphones. However, these examples are not intended to be limiting and persons skilled in the relevant art(s) will readily appreciate that other methods may be used to calculate the reference power.

In one implementation of the foregoing embodiment, distortion calculator 108 is configured to calculate a measure of distortion for the beam response by calculating a measure of distortion for the beam response at each of a plurality of frequencies and then summing the measure of distortions so calculated across the plurality of frequencies. In accordance with such an implementation, distortion calculator 108 may calculate the measure of distortion for the beam response by calculating:

$$\sum_f ||B(f,t)|^2-|mic(f,t)|^2|,$$

wherein B(f,t) is the response of the beam at frequency f and time t, $||B(f,t)|^2$ is the power of the response of the beam at frequency f and time t, $|mic(f,t)|^2$ is the reference power at frequency f and time t, and $||B(f,t)|^2-|mic(f,t)|^2|$ is the response power distortion for the beam at frequency f and time t.

In a further implementation of the foregoing embodiment, distortion calculator 108 is configured to calculate a measure of distortion for the beam response by calculating a measure of distortion for the beam response at each of a plurality of frequencies, multiplying each measure of distortion so calculated by a frequency-dependent weight to produce a plurality of frequency-weighted measures of distortion, and then summing the frequency-weighted measures of distortion. In accordance with such an implementation, distortion calculator 108 may calculate the measure of distortion for the beam response by calculating:

$$\sum_f ||B(f,t)|^2 - |mic(f,t)|^2| \cdot W(f),$$

wherein W(f) is a spectral weight associated with frequency f and wherein the remaining variables are defined as set forth in the preceding paragraph.

In an alternate embodiment, distortion calculator 108 is configured to calculate the measure of distortion for the beam response received from beamformer 106 by calculating a power of a difference between the beam response and a reference response. The measure of distortion in such an embodiment may be termed the response distortion power. For example, in an embodiment, distortion calculator 108 may calculate the measure of distortion for the beam response by calculating:

$$|B(t)-mic(t)|^2,$$

wherein B(t) is the response of the beam at time t, mic(t) is the reference response at time t, and $|B(t)-mic(t)|^2$ is the response distortion power for the beam at time t.

In the foregoing embodiment, the reference response mic (t) comprises the response of a designated microphone in the array of microphones. However, this example is not intended to be limiting and persons skilled in the art will readily appreciate that other methods may be used to determine the reference response.

In one implementation of the foregoing embodiment, distortion calculator 108 is configured to calculate a measure of distortion for the beam response by calculating a measure of distortion for the beam response at each of a plurality of frequencies and then summing the measure of distortions so calculated across the plurality of frequencies. In accordance with such an implementation, distortion calculator 108 may calculate the measure of distortion for the beam response by calculating:

$$\sum_f |B(f,t) - mic(f,t)|^2,$$

wherein B(f,t) is the response of the beam at frequency f and time t, mic(f,t) is the reference response at frequency f and time t, and $|B(f,t)-mic(f,t)|^2$ is the response distortion power for the beam at frequency f and time t.

In a further implementation of the foregoing embodiment, distortion calculator 108 is configured to calculate a measure of distortion for the beam response by calculating a measure of distortion for the beam response at each of a plurality of frequencies, multiplying each measure of distortion so calculated by a frequency-dependent weight to produce a plurality of frequency-weighted measures of distortion, and then summing the frequency-weighted measures of distortion. In accordance with such an implementation, distortion calculator 108 may calculate the measure of distortion for the beam response by calculating:

$$\sum_f |B(f,t) - mic(f,t)|^2 \cdot W(f),$$

wherein W(f) is a spectral weight associated with frequency f and wherein the remaining variables are defined as set forth in the preceding paragraph.

The foregoing approaches for determining a measure of distortion for the beam response received from beamformer 106 with respect to a reference power or reference response have been provided herein by way of example only and are not intended to limit the present invention. Persons skilled in the relevant art(s) will readily appreciate that other approaches may be used to determine the measure of distortion. For example, rather than measuring the distortion of the response power for the beam response, distortion calculator 108 may measure the distortion of the response magnitude for the beam response. As another example, rather than measuring the power of the response distortion for the beam response, distortion calculator 108 may measure the magnitude of the response distortion for the beam response. Still other approaches may be used.

Output audio signal generator 110 is configured to receive the spatially-filtered audio signal generated by beamformer 106 and an audio signal output by a designated microphone within microphone array 102. The designated microphone may comprise a microphone used by distortion calculator 108 to generate a reference power or reference response as previously described, although the invention is not so limited. Decision logic 124 within output audio signal generator 110 receives the measure of distortion from distortion calculator 108 and, based at least on the measure of distortion, determines which of the two signals should be provided as an output audio signal to acoustic transmitter 112. The logic by which the selection is actually made is represented as a switch 122 in FIG. 1. Persons skilled in the relevant art(s) will readily appreciate that switch 122 is not intended to represent an actual electromechanical switch, but rather any suitable software or hardware configured to perform a switching function.

It is to be understood from the foregoing that beamformer 106 periodically generates a new beam response and that distortion calculator 108 periodically calculates a new measure of distortion for each new beam response. Distortion calculator 108 thus periodically provides an updated measure of distortion to decision logic 124. As a result, decision logic 124 can monitor the quality of the performance of beamformer 106 over time and use this information to determine when it is preferable to provide the beamformer output for acoustic transmission and when it is preferable to provide the output from the designated microphone for acoustic transmission. For example, during periods when beamformer 106 is performing effectively, the beamformer output may be provided for acoustic transmission, while during periods when beamformer 106 is not performing effectively, the output of the designated microphone may be provided for acoustic transmission.

Determining whether beamformer 106 is operating effectively may involve comparing the measure of distortion produced by distortion calculator 108 to one or more thresholds.

For example, in one embodiment, while output audio signal generator 110 is operating in a mode in which the spatially-filtered audio signal generated by beamformer 106 is being provided to acoustic transmitter 112, decision logic 124 receives the distortion measure periodically provided by distortion calculator 108 and compares the distortion measure to each of a first and second threshold, wherein the first threshold is higher than the second threshold. If the distortion measure exceeds the first threshold at any point in time, then decision logic 124 will cause switch 122 to switch from providing the spatially-filtered audio signal generated by beamformer 106 to acoustic transmitter 112 to providing the audio signal output by the designated microphone to acoustic transmitter 112. Furthermore, if the distortion measure does not exceed the first threshold but exceeds the second (lower) threshold for a predetermined number of periods, then decision logic 124 will cause switch 122 to switch from providing the spatially-filtered audio signal generated by beamformer 106 to acoustic transmitter 112 to providing the audio signal output by the designated microphone to acoustic transmitter 112. In this embodiment, the first threshold may be thought of as the threshold at which beamformer performance is considered so unacceptable that an immediate switch to a single microphone output is justified, whereas the second threshold may be thought of as the threshold at which beamformer performance is considered marginally acceptable such that it may be tolerated but only for a predetermined amount of time.

In a further embodiment, while output audio signal generator 110 is operating in a mode in which the audio signal output by the designated microphone is being provided to acoustic transmitter 112, decision logic 124 receives the distortion measure periodically provided by distortion calculator 108 and compares the distortion measure to a threshold, such as, for example, the second threshold described above. If the distortion measure does not exceed the threshold for a predetermined number of periods, then decision logic 124 will cause switch 122 to switch from providing the audio signal output by the designated microphone to acoustic transmitter 112 to providing the spatially-filtered audio signal generated by beamformer 106 to acoustic transmitter 112. In this embodiment, then, if beamformer performance has shown a sustained improvement over a predetermined amount of time, then a switch back to beamformer output is justified.

In one embodiment, distortion calculator 108 determines the measure of distortion for the beam response received from beamformer 106 only at times and/or frequencies at which the audio signals being captured by microphone array 102 are deemed to be "desired" audio signals. For example, when the audio signals consist mostly of interference (e.g., noise or acoustic echo), then the distortion produced by beamformer 106 is desirable since it represents attenuation of the interference. Consequently, such distortion should not be used as a basis for disabling beamforming as described above. In accordance with this embodiment, distortion calculator 108 includes logic configured to distinguish between a desired audio signal and an undesired audio signal in the time and/or frequency domain. Such logic may include for example voice activity detection logic that is capable of distinguishing between speech and non-speech signals, talker localization logic that is capable of distinguishing between sound waves emanating from a desired talker and sound waves emanating from one or more undesired audio sources, and/or logic that is capable of identifying acoustic echo generated by a loudspeaker associated with system 100.

In an alternate embodiment, distortion calculator 108 determines the measure of distortion for the beam response received from beamformer 106 regardless of whether the audio signals being captured by microphone array 102 are deemed to be "desired" audio signals and decision logic 124 determines whether or not the measure of distortion is valid. If the measure is valid, then it is used to make a beamformer disabling/enabling decision but if it is invalid, it is ignored. In accordance with such an embodiment, decision logic 124 includes logic configured to determine whether the audio signals being captured by microphone array 102 are deemed to be desired or undesired audio signals.

Acoustic transmitter 112 is configured to receive the output audio signal generated by output audio signal generator 110 and to transmit the output audio signal over a wired and/or wireless communication medium to a remote system or device where it may be played back, for example, to one or more far end listeners.

In one embodiment, at least a portion of the operations performed by each of beamformer 106, distortion calculator 108, output audio signal generator 110 and acoustic transmitter 112 is implemented in software. In accordance with such an implementation, the software operations are carried out via the execution of instructions by one or more general purpose or special-purpose processors. In further accordance with such an implementation, digital audio samples, control parameters, and variables used during software execution may be read from and/or written to one or more data storage components, devices, or media that are directly or indirectly accessible to the processor(s).

Figure 2:
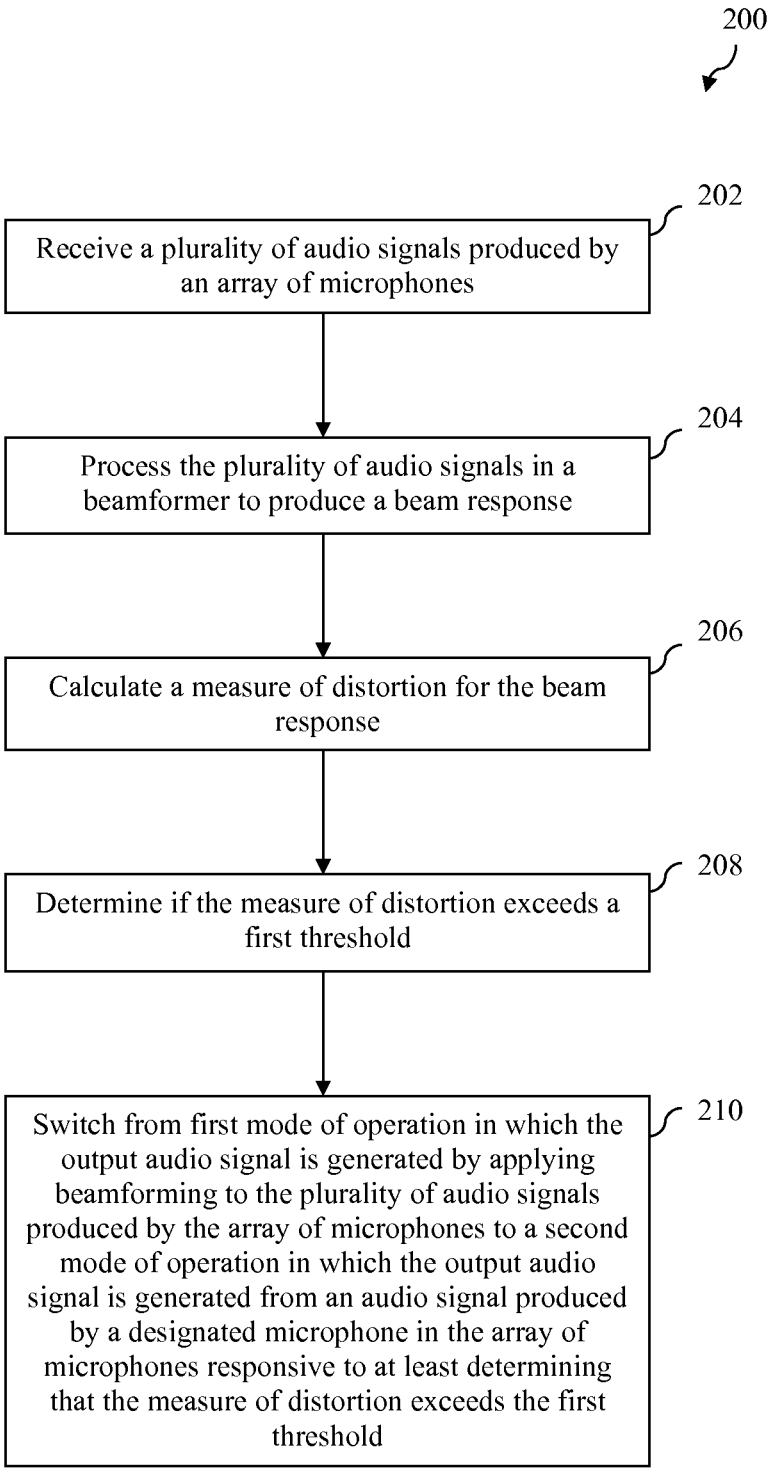
FIG. 2 depicts a flowchart of a method for automatically disabling an acoustic beamformer in accordance with an embodiment of the present invention.

C. Example Method for Automatically Disabling and/or Enabling an Acoustic Beamformer FIG. 2 depicts a flowchart 200 of a method for automatically disabling an acoustic beamformer in accordance with an embodiment of the present invention. The method of flowchart 200 may be implemented by system 100 as described above in reference to FIG. 1. However, the method is not limited to that embodiment and may be implemented by other systems or devices.

As shown in FIG. 2, the method of flowchart 200 begins at step 202 in which a plurality of audio signals produced by an array of microphones is received.

At step 204, the plurality of audio signals is processed in a beamformer to produce a beam response. In one embodiment, step 204 comprises processing the plurality of audio signals in a superdirective beamformer, although this is only an example. In further accordance with such an embodiment, the superdirective beamformer may comprise a fixed or adaptive MVDR beamformer.

At step 206, a measure of distortion is calculated for the beam response. In one embodiment, step 206 comprises calculating an absolute difference between a power of the beam response and a reference power. The reference power may comprise, for example, a power of a response of a designated microphone in the array of microphones. The reference power may alternately comprise, for example, an average response power of two or more designated microphones in the array of microphones.

In an alternate embodiment, step 206 comprises calculating a power of a difference between the beam response and a reference response. The reference response may comprise, for example, a response of a designated microphone in the array of microphones.

As noted above, in one embodiment, step 206 is performed only at times and/or frequencies where the audio signals being captured by the array of microphones are deemed to be "desired" audio signals.

At step 208, a determination is made as to whether the measure of distortion exceeds a first threshold. As further noted above, in one embodiment, the determination of step 208 is performed only when the measure of distortion is deemed valid.

At step 210, responsive to at least determining that the measure of distortion exceeds the first threshold, a switch is made from a first mode of operation in which an output audio signal is generated by applying beamforming to the plurality of audio signals produced by the array of microphones to a second mode of operation in which the output audio signal is generated from an audio signal produced by a designated microphone in the array of microphones.

In one embodiment, steps 202, 204 and 206 are performed on a periodic basis and step 210 comprises switching from the first mode of operation to the second mode of operation responsive to at least determining that the measure of distortion exceeds the first threshold for a predetermined number of periods.

The method of flowchart 200 may further include steps for automatically enabling an acoustic beamformer. For example, the method may further include switching from the second mode of operation back to the first mode of operation responsive to at least determining that the measure of distortion does not exceed a second threshold for a predetermined number of periods. The second threshold may be the same as or different from the first threshold discussed above in reference to steps 208 and 210 depending upon the implementation.

Figure 3:
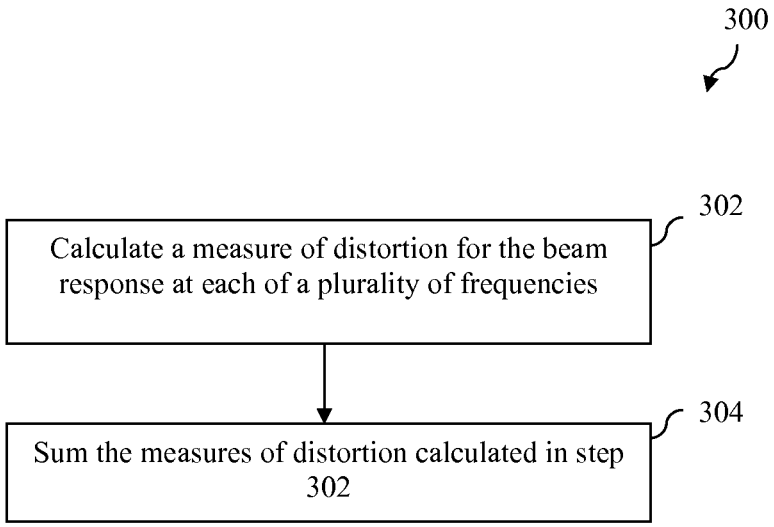
FIG. 3 depicts a flowchart of a method for calculating a measure of distortion based on a beam response in accordance with one embodiment of the present invention.

FIG. 3 depicts a flowchart 300 of a method for calculating a measure of distortion for a beam response in accordance with one embodiment of the present invention. The method of flowchart 300 may be used, for example, to implement step 206 of the method of flowchart 200. As shown in FIG. 3, the method of flowchart 300 begins at step 302 in which a measure of distortion is calculated for the beam response at each of a plurality of frequencies. At step 304, the measures of distortion calculated in step 302 are summed to produce the measure of distortion for the beam response.

Figure 4:
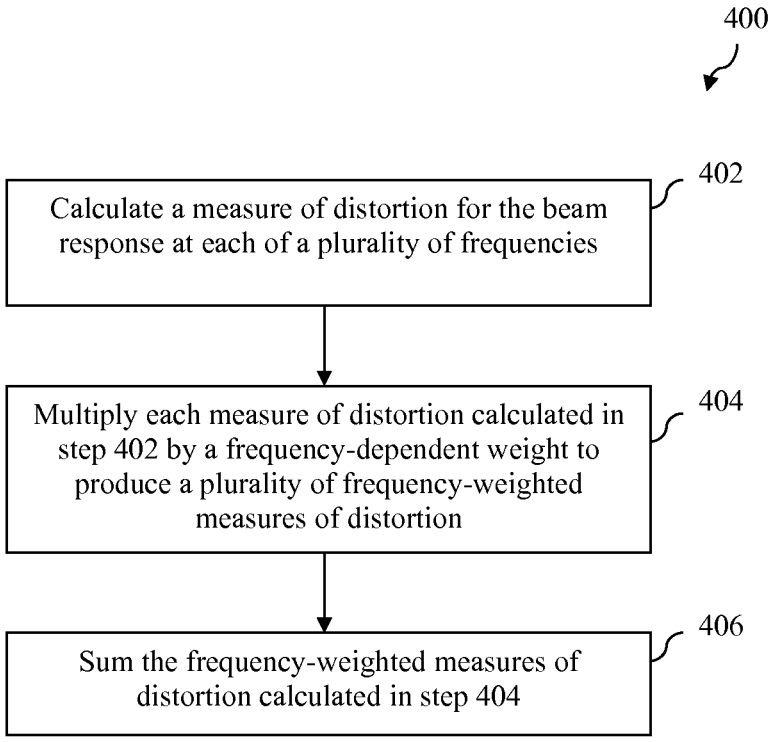
FIG. 4 depicts a flowchart of a method for calculating a measure of distortion based on a beam response in accordance with an alternate embodiment of the present invention.

FIG. 4 depicts a flowchart 400 of a method for calculating a measure of distortion for a beam response in accordance with an alternate embodiment of the present invention. Like the method of flowchart 300, the method of flowchart 400 may be used, for example, to implement step 206 of the method of flowchart 200. As shown in FIG. 4, the method of flowchart 400 begins at step 402 in which a measure of distortion is calculated for the beam response at each of a plurality of frequencies. At step 404, each measure of distortion calculated in step 402 is multiplied by a frequency-dependent weight to produce a plurality of frequency-weighted measures of distortion. At step 406, the frequency-weighted measures of distortion calculated in step 404 are summed to produce the measure of distortion for the beam response.

D. Example Embodiments with Audio Source Localization Functionality

Figure 5:
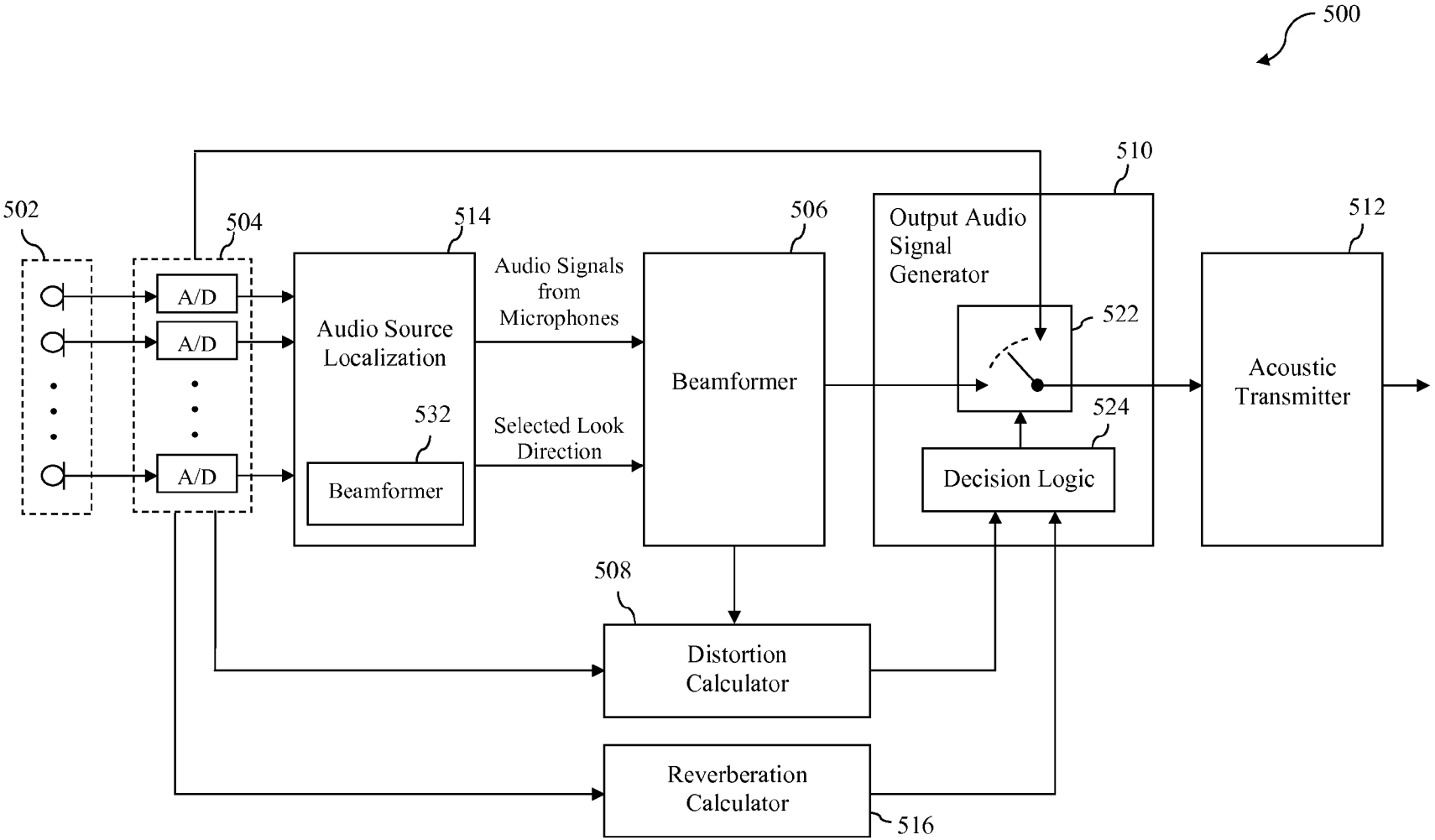
FIG. 5 is a block diagram of a system that automatically disables and enables an acoustic beamformer in accordance with an embodiment of the present invention that includes audio source localization functionality.

FIG. 5 is a block diagram of a system 500 that automatically disables and enables an acoustic beamformer in accordance with an embodiment of the present invention that includes audio source localization functionality. Like system 100 of FIG. 1, system 500 is intended to represent a system that captures audio input for acoustic transmission and thus may represent, for example, a speakerphone, a mobile phone with speakerphone capability, an audio teleconferencing system, an audio/video teleconferencing system, or the like, although these examples are not intended to be limiting. As shown in FIG. 5, system 500 includes a number of interconnected components including an array of microphones 502, an array of A/D converters 504, audio source localization logic 514, a beamformer 506, a distortion calculator 508, a reverberation calculator 516, an output audio signal generator 510, and an acoustic transmitter 512. Each of these components will now be described.

Microphone array 502 and A/D converter array 504 operate in a like manner to microphone array 102 and A/D converter array 104, as described above in reference to FIG. 1, to produce a plurality of digital audio signals. Audio source localization logic 514 receives the digital audio signals and processes them to select a look direction that best estimates the direction of arrival of sound waves emanating from a desired audio source. In one embodiment, a beamformer 532 within audio source localization logic 514 processes the plurality of audio signals to produce a plurality of beam responses each of which is associated with a different look direction. Audio source localization logic 514 then selects a look direction associated with one of the plurality of beam responses.

Various methods may be used to select the look direction associated with one of the plurality of beam responses. For example, in one implementation that utilizes the well-known Steered Response Power (SRP) technique, audio source localization logic 514 selects the look direction associated with the beam that provides the maximum response power. In accordance with an alternative implementation that utilizes techniques described in commonly-owned, co-pending U.S. patent application Ser. No. 12/566,329 (entitled "Audio Source Localization System and Method," filed on Sep. 24, 2009, the entirety of which is incorporated by reference herein), audio source localization logic 514 selects the look direction associated with the beam that produces the smallest measure of distortion.

As shown in FIG. 5, audio source localization logic 514 passes the plurality of digital audio signals produced by arrays 502 and 504 and the selected look direction to beamformer 506. Beamformer 506 is configured to process the digital audio signals to produce a response that corresponds to a beam having the selected look direction. The beam response obtained by beamformer 506 is provided to distortion calculator 508. Like beamformer 106 described above in reference to system 100, beamformer 506 may comprise a superdirective beamformer such as, for example, an MVDR beamformer. However, this example is not intended to be limiting and other types of beamformers may be used.

Note that in an alternate embodiment to that shown in FIG. 5, the functions performed by beamformer 532 and beamformer 506 as described above may be performed by a single beamformer.

Distortion calculator 508 operates in a like manner to distortion calculator 108 described above in reference to system 100 to calculate a reference power or reference response, to calculate a measure of distortion for the beam response received from beamformer 106 with respect to the reference power or reference response, and to provide the measure of distortion for the beam response to output audio signal generator 510. Note that in an embodiment in which audio source localization logic 514 operates in accordance with the techniques described in U.S. patent application Ser. No. 12/566,329, the measure of distortion associated with the beam response may be calculated as part of the process of selecting the look direction associated with a particular beam. Thus, in such an embodiment, the measure of distortion may be produced by audio source localization logic 514 rather than by distortion calculator 508.

Output audio signal generator 510 is configured to receive the spatially-filtered audio signal generated by beamformer 506 and an audio signal output by a designated microphone within microphone array 502. Decision logic 524 within output audio signal generator 110 receives the measure of distortion from distortion calculator 508 and, based at least on the measure of distortion, determines which of the two signals should be provided as an output audio signal to acoustic transmitter 512. The logic by which the selection is actually made is represented as a switch 522 in FIG. 5. Various methods by which such a determination may be made were previously described in reference to output audio signal generator 110 of system 100 and included, for example, comparing the measure of distortion to one or more thresholds.

As further shown in FIG. 5, system 500 further includes a reverberation calculator 516. Reverberation calculator 516 is configured to receive one or more of the digital audio signals generated by array of A/D converters 104 and to process the signal(s) to calculate a degree of reverberation present in the environment in which system 500 is operating. Various metrics and methods are known in the art for calculate a degree of reverberation, any of which may be used to implement reverberation calculator 516. Reverberation calculator 516 provides the calculated degree of reverberation to decision logic 524 on a periodic basis.

Generally speaking, audio source localization logic 514 will not work well in environments in which there is a high degree of reverberation. For example, audio source localization logic 514 may not select the best look direction due to reverberation. This in turn will affect the performance of beamformer 506. Consequently, decision logic 524 can use the calculated degree of reverberation provided by reverberation calculator 516 to determine the best method for generating the output audio signal for acoustic transmission. For example, in one embodiment, decision logic 524 compares the degree of reverberation provided by reverberation calculator 516 to a threshold. If the degree of reverberation does not exceed the threshold, then it may be assumed that audio source localization logic 514 is performing well and the output of beamformer 506 is used to generate the output audio signal for acoustic transmission. However, if the degree of reverberation does exceed the threshold, then it may be assumed that audio source localization logic 514 is not performing well and the output of a single designated microphone in microphone array 502 is used to generate the output audio signal for acoustic transmission. This is only one example of how the degree of reverberation may be used to control generation of the output audio signal and other approaches may also be used.

In one embodiment, decision logic 524 determines the manner in which to generate the output audio signal for acoustic transmission based on both the measure of distortion provided by distortion calculator 508 and the estimated degree of reverberation provided by reverberation calculator 516. Persons skilled in the relevant art(s) will readily appreciate that these metrics may also be used in isolation or in conjunction with other metrics to determine the manner in which to generate the output audio signal for acoustic transmission.

Acoustic transmitter 512 is configured to receive the output audio signal generated by output audio signal generator 510 and to transmit the output audio signal over a wired and/or wireless communication medium to a remote system or device where it may be played back, for example, to one or more far end listeners.

In one embodiment, at least a portion of the operations performed by each of audio source localization logic 514, beamformer 506, distortion calculator 508, reverberation calculator 516, output audio signal generator 510 and acoustic transmitter 512 is implemented in software. In accordance with such an implementation, the software operations are carried out via the execution of instructions by one or more general purpose or special-purpose processors. In further accordance with such an implementation, digital audio samples, control parameters, and variables used during software execution may be read from and/or written to one or more data storage components, devices, or media that are directly or indirectly accessible to the processor(s).

Figure 6:
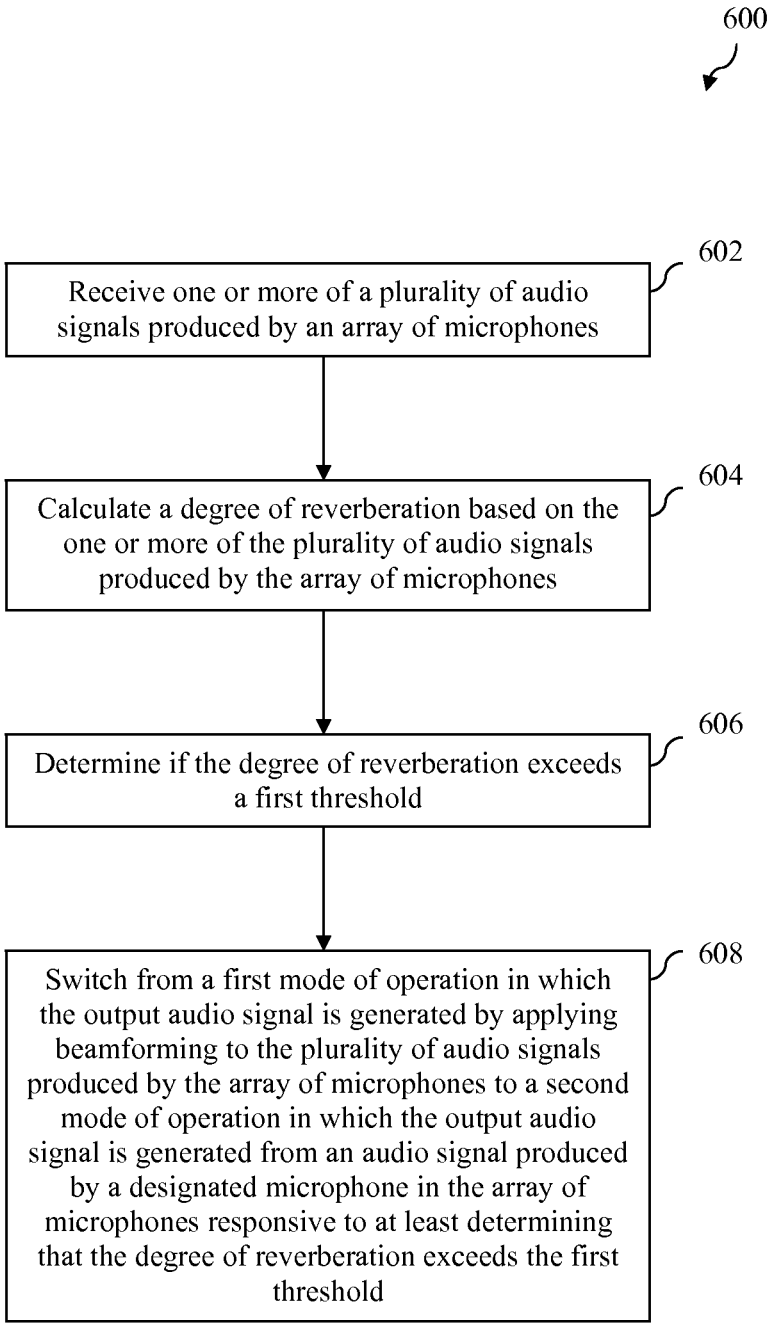
FIG. 6 depicts a flowchart of a method for automatically disabling an acoustic beamformer in accordance with an alternate embodiment of the present invention.

FIG. 6 depicts a flowchart 600 of a method for automatically disabling an acoustic beamformer in accordance with an embodiment of the present invention. The method of flowchart 600 may be implemented by system 500 as described above in reference to FIG. 5. However, the method is not limited to that embodiment and may be implemented by other systems or devices.

As shown in FIG. 6, the method of flowchart 600 begins at step 602 in which one or more of a plurality of audio signals produced by an array of microphones is received.

At step 604, a degree of reverberation is calculated based on the one or more of the plurality of audio signals produced by the array of microphones.

At step 606, it is determined if the degree of reverberation exceeds a first threshold.

At step 608, responsive to at least determining that the degree of reverberation exceeds the first threshold, a switch is made from a first mode of operation in which an output audio signal is generated by applying beamforming to the plurality of audio signals produced by the array of microphones to a second mode of operation in which the output audio signal is generated from an audio signal produced by a designated microphone in the array of microphones.

In one embodiment, steps 602, 604 and 606 are performed on a periodic basis and step 608 comprises switching from the first mode of operation to the second mode of operation responsive to at least determining that the measure of distortion exceeds the first threshold for a predetermined number of periods.

The method of flowchart 600 may further include steps for automatically enabling an acoustic beamformer. For example, the method may further include switching from the second mode of operation back to the first mode of operation responsive to at least determining that the degree of reverberation does not exceed a second threshold for a predetermined number of periods. The second threshold may be the same as or different from the first threshold discussed above in reference to steps 606 and 608 depending upon the implementation.

Figure 7:
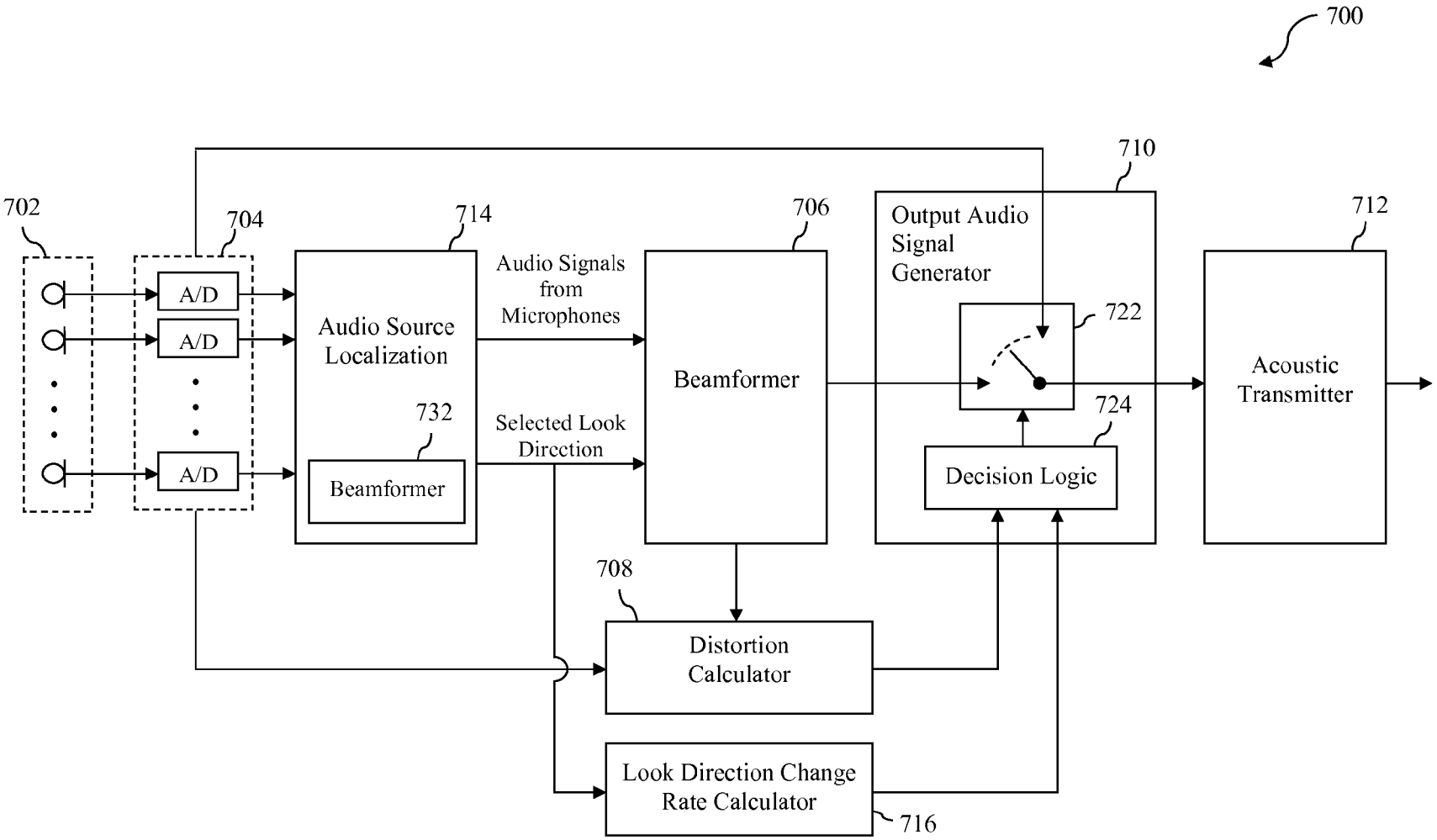
FIG. 7 is a block diagram of a system that automatically disable and enables an acoustic beamformer in accordance with an alternate embodiment of the present invention that includes audio source localization functionality.

FIG. 7 is a block diagram of a system 700 that automatically disables and enables an acoustic beamformer in accordance with a further embodiment of the present invention that includes audio source localization functionality. Like system 100 of FIG. 1 and system 500 of FIG. 5, system 700 is intended to represent a system that captures audio input for acoustic transmission and thus may represent, for example, a speakerphone, a mobile phone with speakerphone capability, an audio teleconferencing system, an audio/video teleconferencing system, or the like, although these examples are not intended to be limiting. As shown in FIG. 7, system 700 includes a number of interconnected components including an array of microphones 702, an array of A/D converters 704, audio source localization logic 714, a beamformer 706, a distortion calculator 708, a look direction change rate calculator 716, an output audio signal generator 710, and an acoustic transmitter 712. Each of these components will now be described.

Microphone array 702 and A/D converter array 704 operate in a like manner to microphone array 102 and A/D converter array 104, as described above in reference to FIG. 1, to produce a plurality of digital audio signals. Audio source localization logic 714 receives the digital audio signals and processes them in a like manner to audio source localization logic 514 as described above in reference to system 500 of FIG. 5 to select a look direction that best estimates the direction of arrival of sound waves emanating from a desired audio source. In one embodiment, a beamformer 732 within audio source localization logic 714 processes the plurality of audio signals to produce a plurality of beam responses each of which is associated with a different look direction. Audio source localization logic 714 then selects a look direction associated with one of the plurality of beam responses.

As shown in FIG. 7, audio source localization logic 714 passes the plurality of digital audio signals produced by arrays 702 and 704 and the selected look direction to beamformer 706. Beamformer 706 is configured to process the digital audio signals to produce a response that corresponds to a beam having the selected look direction. The beam response obtained by beamformer 706 is provided to distortion calculator 708. Like beamformer 506 described above in reference to system 500, beamformer 706 may comprise a superdirective beamformer such as, for example, an MVDR beamformer. However, this example is not intended to be limiting and other types of beamformers may be used.

Note that in an alternate embodiment to that shown in FIG. 7, the functions performed by beamformer 732 and beamformer 706 as described above may be performed by a single beamformer.

Distortion calculator 708 operates in a like manner to distortion calculator 108 described above in reference to system 100 to calculate a reference power or reference response, to calculate a measure of distortion for the beam response received from beamformer 706 with respect to the reference power or reference response, and to provide the measure of distortion for the beam response to output audio signal generator 710. Note that in an embodiment in which audio source localization logic 714 operates in accordance with the techniques described in U.S. patent application Ser. No. 12/566,329, the measure of distortion associated with the beam response may be calculated as part of the process of selecting the look direction associated with a particular beam. Thus, in such an embodiment, the measure of distortion may be produced by audio source localization logic 714 rather than by distortion calculator 708.

Output audio signal generator 710 is configured to receive the spatially-filtered audio signal generated by beamformer 706 and an audio signal output by a designated microphone within microphone array 702. Decision logic 724 within output audio signal generator 710 receives the measure of distortion from distortion calculator 708 and, based at least on the measure of distortion, determines which of the two signals should be provided as an output audio signal to acoustic transmitter 712. The logic by which the selection is actually made is represented as a switch 722 in FIG. 7. Various methods by which such a determination may be made were previously described in reference to output audio signal generator 110 of system 100 and included, for example, comparing the measure of distortion to one or more thresholds.

As further shown in FIG. 7, system 700 further includes a look direction change rate calculator 716. Look direction change rate calculator 716 is configured to monitor the selected look direction produced by audio source localization logic 714 over time and to calculate a rate at which the selected look direction changes. The time period over which the rate is measured may vary depending upon the implementation. Look direction change rate calculator 716 provides the calculated change rate to decision logic 724 on a periodic basis.

Generally speaking, if the look direction selected by audio source localization logic 714 changes too often, this may indicate that audio source localization logic 714 is not working well. This may be due to, for example, a high degree of reverberation in the environment in which system 700 is operating. A rapidly changing look direction will in turn adversely affect the performance of beamformer 706. Consequently, decision logic 724 can use the calculated change rate provided by look direction change rate calculator 716 to determine the best method for generating the output audio signal for acoustic transmission. For example, in one embodiment, decision logic 724 compares the change rate provided by look direction change rate calculator 716 to a threshold. If the change rate does not exceed the threshold, then it may be assumed that audio source localization logic 714 is performing well and the output of beamformer 706 is used to generate the output audio signal for acoustic transmission. However, if the change rate does exceed the threshold, then it may be assumed that audio source localization logic 714 is not performing well and the output of a single designated microphone in microphone array 702 is used to generate the output audio signal for acoustic transmission. This is only one example of how the rate of change of the look direction selected by audio source localization logic 714 may be used to control generation of the output audio signal and other approaches may also be used.

In one embodiment, decision logic 724 determines the manner in which to generate the output audio signal for acoustic transmission based on both the measure of distortion provided by distortion calculator 708 and the change rate provided by look direction change rate calculator 716. Persons skilled in the relevant art(s) will readily appreciate that these metrics may also be used in isolation or in conjunction with other metrics (such as the estimated degree of reverberation as discussed above in reference to system 500 of FIG. 5) to determine the manner in which to generate the output audio signal for acoustic transmission.

Acoustic transmitter 712 is configured to receive the output audio signal generated by output audio signal generator 710 and to transmit the output audio signal over a wired and/or wireless communication medium to a remote system or device where it may be played back, for example, to one or more far end listeners.

In one embodiment, at least a portion of the operations performed by each of audio source localization logic 714, beamformer 706, distortion calculator 708, look direction change rate calculator 716, output audio signal generator 710 and acoustic transmitter 712 is implemented in software. In accordance with such an implementation, the software operations are carried out via the execution of instructions by one or more general purpose or special-purpose processors. In further accordance with such an implementation, digital audio samples, control parameters, and variables used during software execution may be read from and/or written to one or more data storage components, devices, or media that are directly or indirectly accessible to the processor(s).

Figure 8:
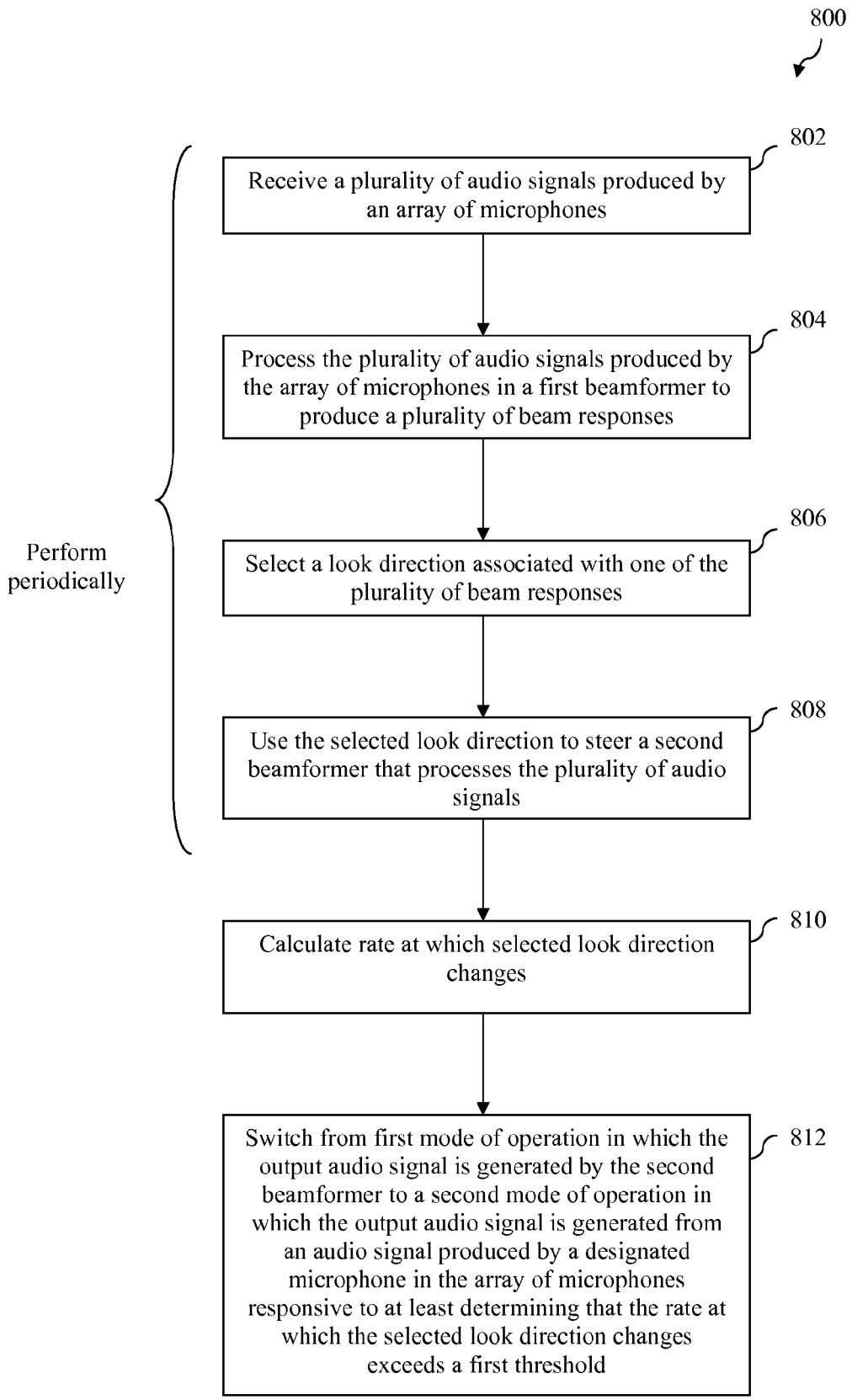
FIG. 8 depicts a flowchart of a method for automatically disabling an acoustic beamformer in accordance with a further alternate embodiment of the present invention.

FIG. 8 depicts a flowchart 800 of a method for automatically disabling an acoustic beamformer in accordance with an embodiment of the present invention. The method of flowchart 800 may be implemented by system 700 as described above in reference to FIG. 7. However, the method is not limited to that embodiment and may be implemented by other systems or devices.

As shown in FIG. 8, the method of flowchart 800 includes steps 802, 804, 806 and 808 which are performed on a periodic basis.

At step 802, a plurality of audio signals produced by an array of microphones is received.

At step 804, the plurality of audio signals produced by the array of microphones is processed in a first beamformer to produce a plurality of beam responses.

At step 806, a look direction associated with one of the plurality of beam responses produced during step 804 is selected.

At step 808, the selected look direction is used to steer a second beamformer that processes the plurality of audio signals.

At step 810, a rate at which the selected look direction changes is calculated.

At step 812, responsive to at least determining that the rate at which the selected look direction changes exceeds a first threshold, a switch is made from a first mode of operation in which an output audio signal is generated by the second beamformer to a second mode of operation in which the output audio signal is generated from an audio signal produced by a designated microphone in the array of microphones.

The method of flowchart 800 may further include steps for automatically enabling an acoustic beamformer. For example, the method may further include switching from the second mode of operation back to the first mode of operation responsive to at least determining that the rate at which the selected look direction changes does not exceed a second threshold. The second threshold may be the same as or different from the first threshold discussed above in reference to step 812 depending upon the implementation.

Figure 9:
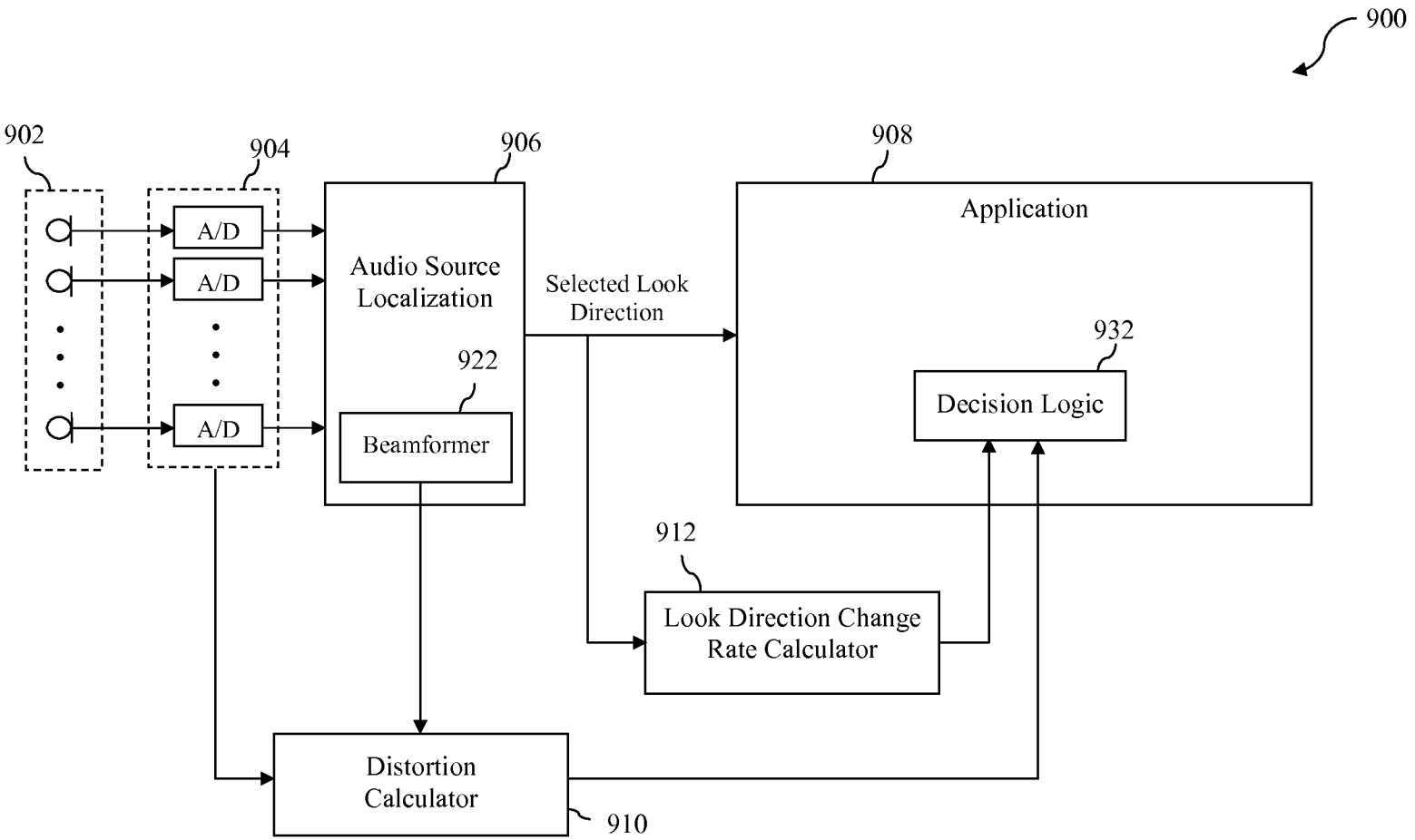
FIG. 9 is a block diagram of a system that automatically disables and enables beamformer-based audio source localization in accordance with an embodiment of the present invention.

Aspects of the present invention may advantageously be implemented in systems that use beamformer-based audio source localization to support applications other than or in addition to acoustic transmission. This concept will now be illustrated with respect to FIGS. 9 and 10. In particular, FIG. 9 is a block diagram of a system 900 that automatically disables and enables beamformer-based audio source localization in accordance with an embodiment of the present invention. As shown in FIG. 9, system 900 includes a number of interconnected components including an array of microphones 902, an array of A/D converters 904, beamformer-based audio source localization logic 906, an application 908, a distortion calculator 910 and a look direction change rate calculator 912. Each of these components will now be described.

Microphone array 902 and A/D converter array 904 operate in a like manner to microphone array 102 and A/D converter array 104, as described above in reference to FIG. 1, to produce a plurality of digital audio signals. Beamformer-based audio source localization logic 906 receives the digital audio signals and processes them in a like manner to audio source localization logic 514 as described above in reference to system 500 of FIG. 5 to select a look direction that best estimates the direction of arrival of sound waves emanating from a desired audio source. To perform this function, a beamformer 922 within audio source localization logic 906 processes the plurality of audio signals to produce a plurality of beam responses each of which is associated with a different look direction. Audio source localization logic 906 then selects a look direction associated with one of the plurality of beam responses. Audio source localization logic 906 passes the selected look direction to application 908 and to look direction change rate calculator 912. Audio source localization logic 906 also passes the beam response associated with the selected look direction to distortion calculator 910.

Distortion calculator 910 operates in a like manner to distortion calculator 108 described above in reference to system 100 to calculate a reference power or reference response and to calculate a measure of distortion for the beam response received from audio source localization logic 906 with respect to the reference power or reference response. Distortion calculator 910 then provides the measure of distortion for the beam response to decision logic 932 within application 908. Note that in an embodiment in which audio source localization logic 906 operates in accordance with the techniques described in U.S. patent application Ser. No. 12/566,329, the measure of distortion associated with the beam response may be calculated as part of the process of selecting the look direction associated with a particular beam. Thus, in such an embodiment, the measure of distortion may be produced by audio source localization logic 906 rather than by distortion calculator 910.

Look direction change rate calculator 912 is configured to monitor the selected look direction produced by audio source localization logic 906 over time and to calculate a rate at which the selected look direction changes. The time period over which the rate is measured may vary depending upon the implementation. Look direction change rate calculator 912 provides the calculated change rate to decision logic 932 within application 908 on a periodic basis.

Application 908 is intended to represent any application that is configured to perform operations based on the selected look direction received from audio source localization logic 906. For example, application 908 may comprise a video teleconferencing application that uses the selected look direction to control a video camera to point at and/or zoom in on a desired audio source, such as a desired talker. As another example, application 908 may comprise a video game application that uses the selected look direction to integrate the current position of a player within a room or other area into the context of a game. For example, the video game application may use the selected look direction to control the placement of an avatar that represents a player within a virtual environment. As a still further example, application 908 may comprise a surround sound gaming application that uses the selected look direction to perform proper sound localization. These examples are provided by way of illustration only and are not intended to be limiting.

As shown in FIG. 9, application 908 includes decision logic 932 that receives the measure of distortion from distortion calculator 910 and the look direction change rate from look direction change rate calculator 912. Based on this information, decision logic 932 determines whether application 908 should operate in a first mode of operation in which the selected look direction provided by audio source localization logic 906 is relied upon to perform one or more functions and a second mode of operation in which the selected look direction provided by audio source localization logic 906 is not relied upon to perform any functions.

For example, in further reference to the example embodiment in which application 908 comprises a video teleconferencing application, the first mode of operation may comprise a mode in which the selected look direction provided by audio source localization logic 906 is used to control the video camera to point at and/or zoom in on the desired audio source and the second mode of operation may comprise a mode in which the video camera is controlled to revert to a wide-angle mode or some other mode that does not rely on the selected look direction. As a further example, in further reference to the example embodiment in which application 908 comprises a video gaming application, the first mode of operation may comprise a mode in which the selected look direction is used to control the placement of the avatar that represents the player within the virtual environment and the second mode of operation may comprise a mode in which the avatar is placed in a default location within the virtual environment or some other mode that does not rely on the selected look direction. These are only examples and persons skilled in the art will readily appreciate that the first and second modes of operation will vary depending upon the application.

Generally speaking, if the distortion measure produced by distortion calculator 910 is too high or if the look direction selected by audio source localization logic 906 changes too often, this may indicate that audio source localization logic 906 is not working well. This may be due to, for example, a high degree of reverberation in the environment in which system 900 is operating. Consequently, decision logic 932 can use the distortion measure provided by distortion calculator 910 and/or the calculated change rate provided by look direction change rate calculator 912 to determine the best mode of operation for application 908. For example, decision logic 932 may compare each of the distortion measure and the calculated change rate to one or more thresholds to determine the best mode of operation for application 908. The decision may be made based on a single comparison or multiple comparisons made over time.

In a further embodiment, system 900 also includes a reverberation calculator such as reverberation calculator 516 described above in reference to FIG. 5 that estimates a degree of reverberation present in the environment of system 900. In accordance with such an embodiment, decision logic 932 may be further configured to take into account the estimated degree of reverberation in making a decision regarding the appropriate mode of operation for application 908. Persons skilled in the relevant art(s) will readily appreciate that any of the metrics described herein for determining if audio source localization logic 906 is performing well may also be used in isolation or in conjunction with other metrics to select the appropriate mode of operation for application 908.

In one embodiment, at least a portion of the operations performed by each of audio source localization logic 906, distortion calculator 910, look direction change rate calculator 912 and application 908 is implemented in software. In accordance with such an implementation, the software operations are carried out via the execution of instructions by one or more general purpose or special-purpose processors. In further accordance with such an implementation, digital audio samples, control parameters, and variables used during software execution may be read from and/or written to one or more data storage components, devices, or media that are directly or indirectly accessible to the processor(s).

Figure 10:
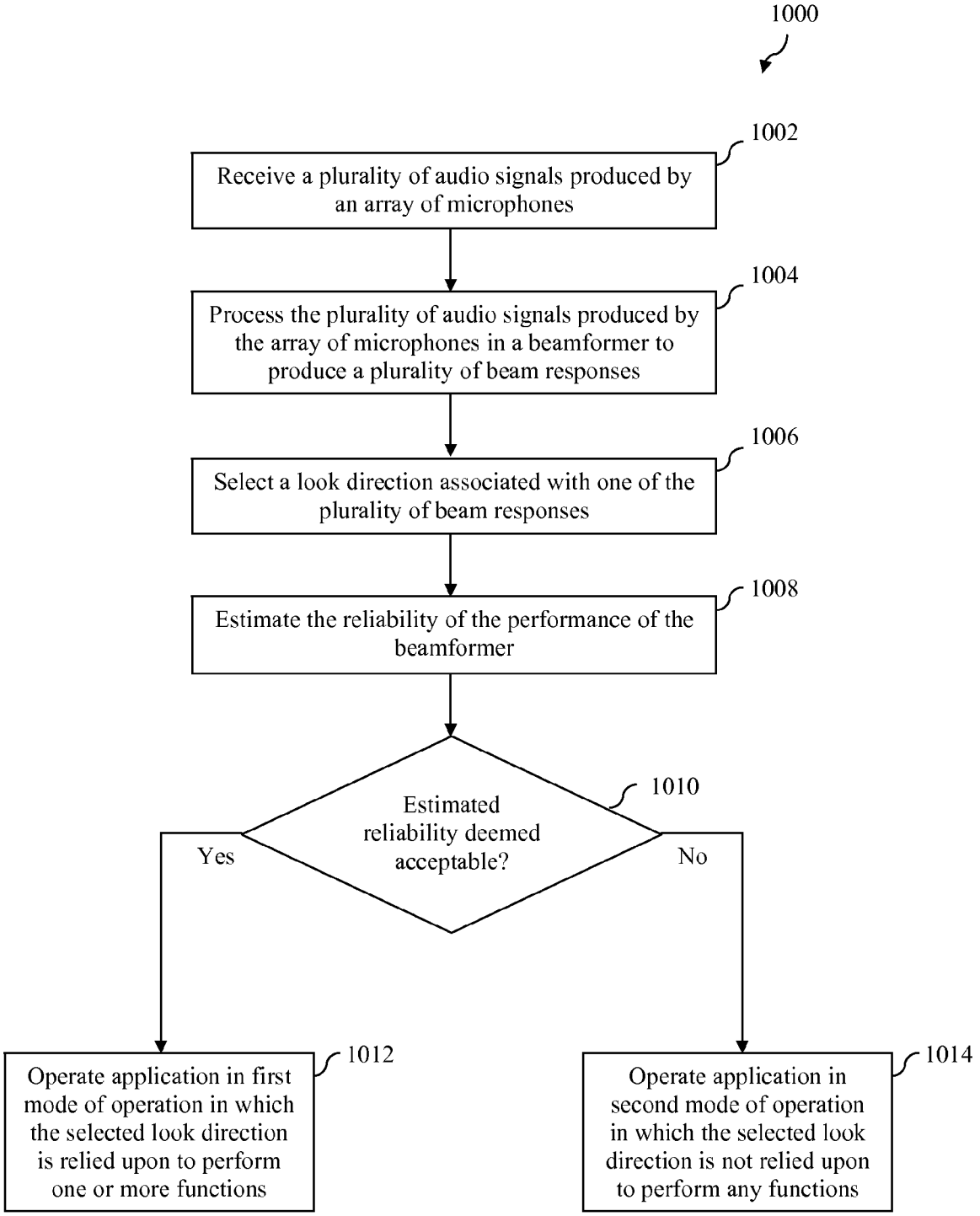
FIG. 10 depicts a flowchart of a method for automatically disabling and enabling beamformer-based audio source localization in accordance with an embodiment of the present.

FIG. 10 depicts a flowchart 1000 of a method for automatically disabling and enabling beamformer-based audio source localization in accordance with an embodiment of the present. The method of flowchart 1000 may be implemented by system 900 as described above in reference to FIG. 9. However, the method is not limited to that embodiment and may be implemented by other systems or devices.

As shown in FIG. 10, the method of flowchart 1000 begins at step 1002 in which a plurality of audio signals produced by an array of microphones is received.

At step 1004, the plurality of audio signals produced by the array of microphones is processed in a beamformer to produce a plurality of beam responses.

At step 1006, a look direction associated with one of the plurality of beam responses produced during step 1004 is selected.

At step 1008, the reliability of the performance of the beamformer is estimated. As discussed above, estimating the reliability of the performance of the beamformer may include performing one or more of: calculating a measure of distortion for the beam response associated with the selected look direction, calculating a level of reverberation based on one or more of the plurality of audio signals produced by the array of microphones, and determining a rate at which the selected look direction has changed.

At decision step 1010, a determination is made as to whether the estimated reliability is deemed acceptable or unacceptable. This step may include, for example, comparing one or more of the measure of distortion, the level of reverberation, or the rate at which the selected look direction has changed to one or more corresponding thresholds. For each metric that is analyzed, the determination may be made based on a single comparison or multiple comparisons made over time.

If the estimated reliability is deemed acceptable, then processing proceeds to step 1012 in which the application is operated in a first mode of operation in which the selected look direction is relied upon to perform one or more functions. However, if the estimated reliability is deemed unacceptable, then processing proceeds to step 1014 in which the application is operated in a second mode of operation in which the selected look direction is not relied upon to perform any function.

E. Example Computer System Implementation

It will be apparent to persons skilled in the relevant art(s) that various elements and features of the present invention, as described herein, may be implemented in hardware using analog and/or digital circuits, in software, through the execution of instructions by one or more general purpose or special-purpose processors, or as a combination of hardware and software.

Figure 11:
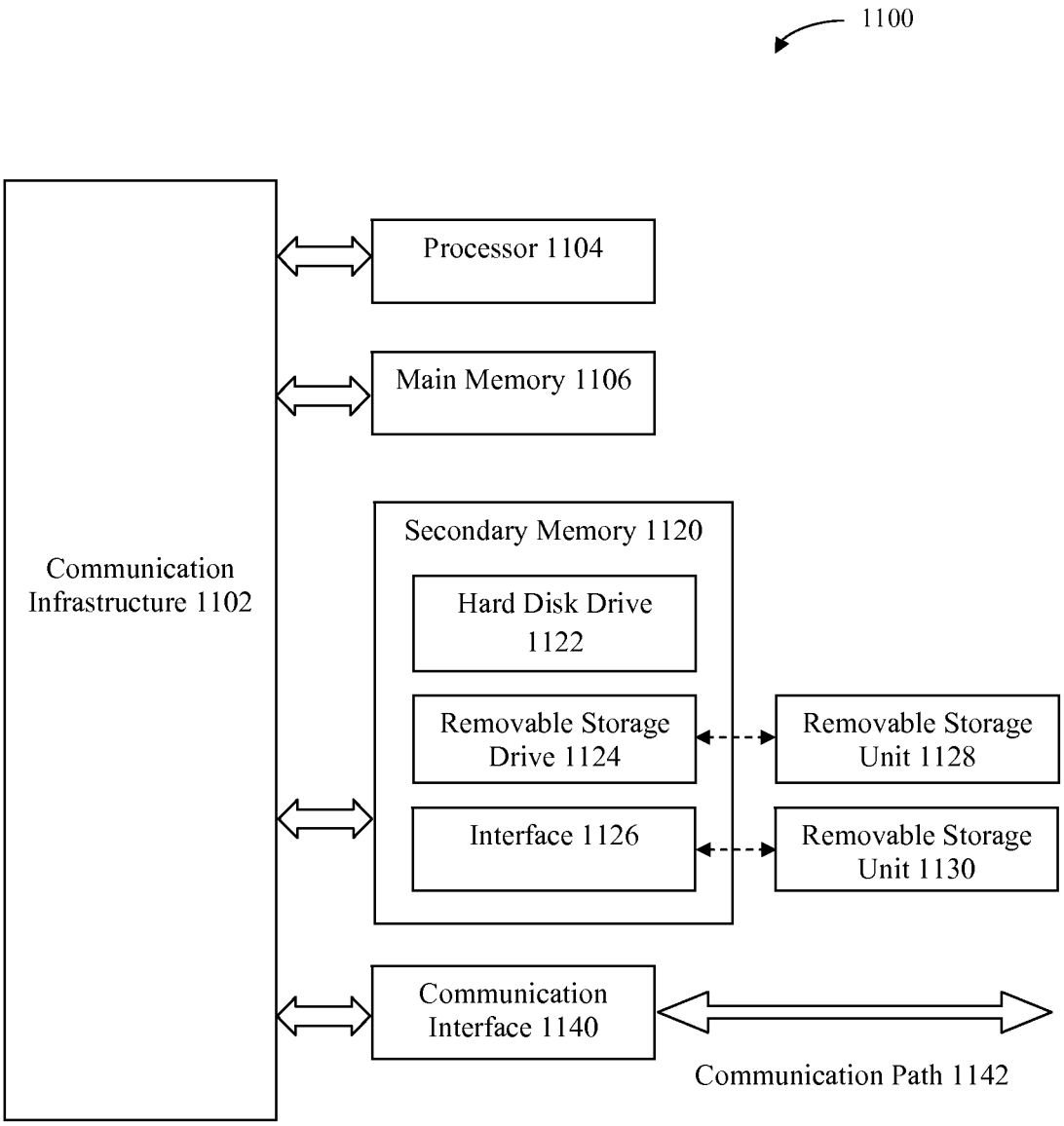
FIG. 11 is a block diagram of a computer system that may be used to implement aspects of the present invention.

The following description of a general purpose computer system is provided for the sake of completeness. Embodiments of the present invention can be implemented in hardware, or as a combination of software and hardware. Consequently, embodiments of the invention may be implemented in the environment of a computer system or other processing system. An example of such a computer system 1100 is shown in FIG. 11. All of the logic blocks depicted in FIGS. 1, 5, 7 and 9, for example, can execute on one or more distinct computer systems 1100. Furthermore, all of the steps of the flowcharts depicted in FIGS. 2-4, 6, 8 and 10 can be implemented on one or more distinct computer systems 1100.

Computer system 1100 includes one or more processors, such as processor 1104. Processor 1104 can be a special purpose or a general purpose digital signal processor. Processor 1104 is connected to a communication infrastructure 1102 (for example, a bus or network). Various software implementations are described in terms of this exemplary computer system. After reading this description, it will become apparent to a person skilled in the relevant art(s) how to implement the invention using other computer systems and/or computer architectures.

Computer system 1100 also includes a main memory 1106, preferably random access memory (RAM), and may also include a secondary memory 1120. Secondary memory 1120 may include, for example, a hard disk drive 1122 and/or a removable storage drive 1124, representing a floppy disk drive, a magnetic tape drive, an optical disk drive, or the like. Removable storage drive 1124 reads from and/or writes to a removable storage unit 1128 in a well known manner. Removable storage unit 1128 represents a floppy disk, magnetic tape, optical disk, or the like, which is read by and written to by removable storage drive 1124. As will be appreciated by persons skilled in the relevant art(s), removable storage unit 1128 includes a computer usable storage medium having stored therein computer software and/or data.

In alternative implementations, secondary memory 1120 may include other similar means for allowing computer programs or other instructions to be loaded into computer system 1100. Such means may include, for example, a removable storage unit 1130 and an interface 1126. Examples of such means may include a program cartridge and cartridge interface (such as that found in video game devices), a removable memory chip (such as an EPROM, or PROM) and associated socket, and other removable storage units 1130 and interfaces 1126 which allow software and data to be transferred from removable storage unit 1130 to computer system 1100.

Computer system 1100 may also include a communications interface 1140. Communications interface 1140 allows software and data to be transferred between computer system 1100 and external devices. Examples of communications interface 1140 may include a modem, a network interface (such as an Ethernet card), a communications port, a PCMCIA slot and card, etc. Software and data transferred via communications interface 1140 are in the form of signals which may be electronic, electromagnetic, optical, or other signals capable of being received by communications interface 1140. These signals are provided to communications interface 1140 via a communications path 1142. Communications path 1142 carries signals and may be implemented using wire or cable, fiber optics, a phone line, a cellular phone link, an RF link and other communications channels.

As used herein, the terms "computer program medium" and "computer readable medium" are used to generally refer to media such as removable storage units 1128 and 1130 or a hard disk installed in hard disk drive 1122. These computer program products are means for providing software to computer system 1100.

Computer programs (also called computer control logic) are stored in main memory 1106 and/or secondary memory 1120. Computer programs may also be received via communications interface 1140. Such computer programs, when executed, enable the computer system 1100 to implement the present invention as discussed herein. In particular, the computer programs, when executed, enable processor 1100 to implement the processes of the present invention, such as any of the methods described herein. Accordingly, such computer programs represent controllers of the computer system 1100. Where the invention is implemented using software, the software may be stored in a computer program product and loaded into computer system 1100 using removable storage drive 1124, interface 1126, or communications interface 1140.

In another embodiment, features of the invention are implemented primarily in hardware using, for example, hardware components such as application-specific integrated circuits (ASICs) and gate arrays. Implementation of a hardware state machine so as to perform the functions described herein will also be apparent to persons skilled in the relevant art(s).

F. Conclusion

While various embodiments of the present invention have been described above, it should be understood that they have been presented by way of example only, and not limitation. It will be understood by those skilled in the relevant art(s) that various changes in form and details may be made to the embodiments of the present invention described herein without departing from the spirit and scope of the invention as defined in the appended claims. Accordingly, the breadth and scope of the present invention should not be limited by any of the above-described exemplary embodiments, but should be defined only in accordance with the following claims and their equivalents.

What is claimed is:

1. A method for generating an output audio signal, comprising:

receiving a plurality of audio signals produced by an array of microphones;

processing the plurality of audio signals in a beamformer to produce a beam response;

calculating a measure of distortion for the beam response;

determining if the measure of distortion exceeds a first threshold; and switching from a first mode of operation in which the output audio signal is generated by applying beamforming to the plurality of audio signals produced by the array of microphones to a second mode of operation in which the output audio signal is generated from an audio signal produced by a designated microphone in the array of microphones responsive to at least determining that the measure of distortion exceeds the first threshold.

2. The method of claim 1, wherein processing the plurality of audio signals in a beamformer comprises processing the plurality of audio signals in a superdirective beamformer.

3. The method of claim 2, wherein processing the plurality of audio signals in a beamformer comprises processing the plurality of audio signals in a Minimum Variance Distortionless Response (MVDR) beamformer.

4. The method of claim 1, wherein calculating the measure of distortion comprises:

calculating an absolute difference between a power of the beam response and a reference power.

5. The method of claim 4, wherein the reference power comprises a power of a response of a single microphone in the array of microphones.

6. The method of claim 4, wherein the reference power comprises an average response power of two or more microphones in the array of microphones.

7. The method of claim 1, wherein calculating the measure of distortion comprises:

calculating a power of a difference between the beam response and a reference response.

8. The method of claim 7, wherein the reference response comprises a response of a single microphone in the array of microphones.

9. The method of claim 1, wherein calculating the measure of distortion comprises:

(a) calculating a measure of distortion for the beam response at each of a plurality of frequencies;

(b) summing the measures of distortion calculated in step (a).

10. The method of claim 1, wherein calculating the measure of distortion comprises:

(a) calculating a measure of distortion for the beam response at each of a plurality of frequencies;

(b) multiplying each measure of distortion calculated in step (a) by a frequency-dependent weight to produce a plurality of frequency-weighted measures of distortion; and (c) summing the frequency-weighted measures of distortion calculated in step (b).

11. The method of claim 1, wherein the receiving, processing and calculating steps are performed on a periodic basis and wherein switching from the first mode of operation to the second mode of operation responsive to at least determining that the measure of distortion exceeds the first threshold comprises:

switching from the first mode of operation to the second mode of operation responsive to at least determining that the measure of distortion exceeds the first threshold for a predetermined number of periods.

12. The method of claim 11, further comprising:

switching from the second mode of operation to the first mode of operation responsive to at least determining that the measure of distortion does not exceed a second threshold for a predetermined number of periods.

13. A method for generating an output audio signal, comprising:

calculating a level of reverberation based on one or more of a plurality of audio signals produced by an array of microphones;

determining if the level of reverberation exceeds a first threshold;

switching from a first mode of operation in which the output audio signal is generated by applying beamforming to the plurality of audio signals produced by the array of microphones to a second mode of operation in which the output audio signal is generated from the audio signal produced by a designated microphone in the array of microphones responsive to at least determining that the level of reverberation exceeds the first threshold.

14. The method of claim 13, further comprising:

switching from the second mode of operation to the first mode of operation responsive to at least determining that the level of reverberation does not exceed a second threshold.

15. A method for generating an output audio signal, comprising:

on a periodic basis, receiving a plurality of audio signals from an array of microphones, processing the plurality of audio signals produced by the array of microphones in a first beamformer to produce a plurality of beam responses, selecting a look direction associated with one of the plurality of beam responses, and using the selected look direction to steer a second beamformer that processes the plurality of audio signals; and switching from a first mode of operation in which the output audio signal is generated by the second beamformer to a second mode of operation in which the output audio signal is generated from an audio signal produced by a designated microphone in the array of microphones responsive to at least determining that a rate at which the selected look direction changes exceeds a first threshold.

16. The method of claim 15, further comprising:

switching from the second mode of operation to the first mode of operation responsive to at least determining that the rate at which the selected look direction changes does not exceed a second threshold.

17. A system, comprising:

an array of microphones;

a beamformer that processes a plurality of audio signals produced by the array of microphones to produce a beam response;

a distortion calculator that calculating a measure of distortion for the beam response;

an output audio signal generator that determines if the measure of distortion exceeds a first threshold and switches from a first mode of operation in which an output audio signal is generated by applying beamforming to the plurality of audio signals produced by the array of microphones to a second mode of operation in which the output audio signal is generated from an audio signal produced by a designated microphone in the array of microphones responsive to at least determining that the measure of distortion exceeds the first threshold.

18. The system of claim 17, wherein the beamformer comprises a superdirective beamformer.

19. The system of claim 18, wherein the superdirective beamformer comprises a Minimum Variance Distortionless Response (MVDR) beamformer.

20. The system of claim 17, wherein the distortion calculator calculates the measure of distortion by calculating an absolute difference between a power of the beam response and a reference power.

21. The system of claim 20, wherein the reference power comprises a power of a response of a single microphone in the array of microphones.

22. The system of claim 20, wherein the reference power comprises an average response power of two or more microphones in the array of microphones.

23. The system of claim 17, wherein the distortion calculator calculates the measure of distortion by calculating a power of a difference between the beam response and a reference response.

24. The system of claim 23, wherein the reference response comprises a response of a single microphone in the array of microphones.

25. The system of claim 17, wherein the distortion calculator calculates the measure of distortion by:

(a) calculating a measure of distortion for the beam response at each of a plurality of frequencies;

(b) summing the measures of distortion calculated in step (a).

26. The system of claim 17, wherein the distortion calculator calculates the measure of distortion by:

(a) calculating a measure of distortion for the beam response at each of a plurality of frequencies;

(b) multiplying each measure of distortion calculated in step (a) by a frequency-dependent weight to produce a plurality of frequency-weighted measures of distortion; and (c) summing the frequency-weighted measures of distortion calculated in step (b).

27. The system of claim 17, wherein the beamformer and the distortion calculator operate on a periodic basis to produce the beam response and calculate the measure of distortion based on the beam response, respectively, and wherein the output audio signal generator switches from the first mode of operation to the second mode of operation responsive to at least determining that the measure of distortion exceeds the first threshold for a predetermined number of periods.

28. The system of claim 27, wherein the output audio signal generator switches from the second mode of operation to the first mode of operation responsive to at least determining that the measure of distortion does not exceed a second threshold for a predetermined number of periods.

29. A system comprising:

an array of microphones;

a reverberation calculator that calculates a level of reverberation based on one or more of a plurality of audio signals produced by the array of microphones; and an output audio signal generator that determines if the level of reverberation exceeds a threshold and that switches from a first mode of operation in which an output audio signal is generated by applying beamforming to the plurality of audio signals produced by the array of microphones to a second mode of operation in which the output audio signal is generated from the audio signal produced by a designated microphone in the array of microphones responsive to at least determining that the level of reverberation exceeds the threshold.

30. The system of claim 29, wherein the output audio signal generator switches from the second mode of operation to the first mode of operation responsive to at least determining that the level of reverberation does not exceed a second threshold.

31. A system, comprising:

an array of microphones:

audio source localization logic that periodically processes a plurality of audio signals produced by the array of microphones in a first beamformer to produce a plurality of beam responses, selects a look direction associated with one of the plurality of beam responses, and uses the selected look direction to steer a second beamformer that processes the plurality of audio signals; and an output audio signal generator that switches from a first mode of operation in which an output audio signal is generated by the second beamformer to a second mode of operation in which the output audio signal is generated from an audio signal produced by a designated microphone in the array of microphones responsive to at least determining that a frequency at which the selected look direction changes exceeds a threshold.

32. The system of claim 31, wherein the output audio signal generator switches from the second mode of operation to the first mode of operation responsive to at least determining that the rate at which the selected look direction changes does not exceed a second threshold.

33. A method for generating an output audio signal, comprising:

on a periodic basis, receiving a plurality of audio signals from an array of microphones, processing the plurality of audio signals produced by the array of microphones in a beamformer to produce a plurality of beam responses, selecting a look direction associated with one of the plurality of beam responses, and using the selected look direction to steer the beamformer; and switching from a first mode of operation in which the output audio signal is generated by the beamformer to a second mode of operation in which the output audio signal is generated from an audio signal produced by a designated microphone in the array of microphones responsive to at least determining that a rate at which the selected look direction changes exceeds a first threshold.

34. A method, comprising:

receiving a plurality of audio signals from an array of microphones;

processing the plurality of audio signals produced by the array of microphones in a beamformer to produce a plurality of beam responses;

selecting a look direction associated with one of the plurality of beam responses;

estimating a reliability of the performance of the beamformer;

operating an application in a first mode of operation in which the selected look direction is relied upon to perform one or more functions responsive to determining that the estimated reliability of the performance of the beamformer is acceptable; and operating the application in a second mode of operation in which the selected look direction is not relied upon to perform any functions responsive to determining that the estimated reliability of the performance of the beamformer is unacceptable.

35. The method of claim 34, wherein estimating the reliability of the performance of the beamformer comprises one or more of:

calculating a measure of distortion for the beam response associated with the selected look direction;

calculating a level of reverberation based on one or more of the plurality of audio signals produced by the array of microphones; and determining a rate at which the selected look direction has changed.

* * * * *